US007133013B2

(12) United States Patent
Kamezaki et al.

(10) Patent No.: US 7,133,013 B2
(45) Date of Patent: Nov. 7, 2006

(54) DISPLAY DEVICE DRIVING CIRCUIT, DRIVING METHOD OF DISPLAY DEVICE, AND IMAGE DISPLAY DEVICE

(75) Inventors: Yutaka Kamezaki, deceased, late of Yokosuka (JP); by Hitoshi Kamezaki, legal representative, Yokosuka (JP); by Masano Kamezaki, legal representative, Yokosuka (JP); Takashige Ohta, Yamatokoriyama (JP); Yoshihiko Katsuda, Ikoma-gun (JP); Kouji Kumada, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 213 days.

(21) Appl. No.: 09/815,257

(22) Filed: Mar. 22, 2001

(65) Prior Publication Data

US 2001/0033278 A1 Oct. 25, 2001

(30) Foreign Application Priority Data

Mar. 30, 2000 (JP) ..... 2000-095542
Feb. 1, 2001 (JP) ..... 2001-026102

(51) Int. Cl.
*G09G 3/36* (2006.01)

(52) U.S. Cl. ..... 345/98; 345/100

(58) Field of Classification Search ..... 345/87, 345/89, 100, 101, 94, 90, 99, 103, 98; 349/33, 349/34, 41, 44

See application file for complete search history.

(56) References Cited

U.S. PATENT DOCUMENTS 6,232,939 B1 * 5/2001 Saito et al. ..... 345/93
6,469,686 B1 * 10/2002 Koyama et al. ..... 345/92
2002/0175887 A1 11/2002 Yamazaki

FOREIGN PATENT DOCUMENTS

| | | |
|---|---|---|
| JP | 04-165329 | 6/1992 |
| JP | 2585463 | 11/1996 |
| JP | 09-127920 | 5/1997 |
| JP | 10-171420 | 6/1998 |
| JP | 11-184434 | 7/1999 |

* cited by examiner

*Primary Examiner*—Amare Mengistu
(74) *Attorney, Agent, or Firm*—David G. Conlin; William J. Daley, Jr.; Edwards, Angell, Palmer & Dodge LLP

(57) ABSTRACT

An image display device includes a display device driving circuit having a scanning signal driving section for outputting display scanning signals according to display data with respect to respective scanning signal lines for displaying an image which is in accordance with the display data with respect to pixels which are disposed in a matrix, and the display device driving circuit includes a control section for controlling the output of the display scanning signals from the scanning signal line driving section to the respective scanning signal lines based on a transition instruction signal for making a transition of output of the display scanning signals to the respective scanning signal lines from successive output to simultaneous output so that the display scanning signals are simultaneously outputted to the plurality of scanning signal lines.

58 Claims, 6 Drawing Sheets

DISPLAY DEVICE DRIVING CIRCUIT, DRIVING METHOD OF DISPLAY DEVICE, AND IMAGE DISPLAY DEVICE

FIELD OF THE INVENTION

The present invention relates to a display device driving circuit, a driving method of a display device, and an image display device, which can set a display area to have an image display area and a non-image area, and which can reduce power consumption.

BACKGROUND OF THE INVENTION

With the advancement of communication infrastructure in portable electronic devices, particularly, in portable phones, more information (image information such as characters, graphics, illustrations, and photographs) are communicated at higher speed. In order to display these information, there is demand for a liquid crystal display section which makes up a display section of portable electronic devices to have a higher display quality with higher resolutions.

To increase resolutions in the liquid crystal display area means increase in number of dots, i.e., pixels, which results in increase in power consumption of the portable electronic devices. Meanwhile, a total power consumption of portable electronic devices needs to be low in order to extend the life of batteries making up a power source.

In order to meet this demand, there have been proposals to reduce power consumption by way of displaying only a required portion of the liquid crystal display section as an image display area.

Conventionally, partial display driving of a TFT (Thin Film Transistor) liquid crystal panel, which is an active-matrix liquid crystal display section, was performed in such a way that a non-image area and an image display area were driven at the same timing. Further, in the case of a simple-matrix liquid crystal panel, Japanese Unexamined Patent Publication No. 184434/1999 (Tokukaihei 11-184434) (published date: Jul. 9, 1999) discloses applying a white signal voltage in the non-image area by applying means prior to a transition into a partial display state. This publication partially recites partial display in a scanning direction of the active-matrix type.

However, in the foregoing publication, the applied voltage gradually changes, i.e., decreases in the pixels in the non-image area to which the white signal voltage was applied, and therefore it was required to apply another white signal voltage to maintain white display. That is, the foregoing publication discloses applying a voltage, equivalent to the voltage applied to the counter electrodes, once to the non-image area, and no subsequent application of the voltage is made to the non-image area (non-display portion). However, since the applied charge diminishes over time in the active-matrix liquid crystal panels, this method is not applicable to the active-matrix liquid crystal panels and it is required to apply a voltage for a certain period also in the non-image area. Thus, the foregoing publication failed to achieve lower power consumption, due to the application of a new white signal voltage.

Further, in the conventional method, in order to maintain the applied voltage, it was required in the active-matrix liquid crystal display panel having counter electrodes, when performing partial display in the scanning line direction, to apply a white signal voltage of the opposite polarity also to a non-display portion where the partial display in the scanning line direction is performed, so as to avoid such drawbacks as image persistence of the liquid crystal.

Conventionally, the non-display portion was scanned by the count-up of the shift register of the gate driver per one horizontal period in the same manner as the display portion. In this case, the output of video signals from the source driver needs to be created, apparently, for the number of outputs of the entire scanning lines, and the power consumption of the liquid crystal panel for the partial display becomes equivalent to that of entire display, thus failing to achieve lower power consumption.

Note that, Japanese Examined Patent Publication No. 2585463/1996 (published date: Jun. 11, 1992) discloses realizing display without change in time axis, when the number of scanning lines in the display area is larger than that of the effective scanning lines of the input video signals, by simultaneously scanning a plurality of scanning lines, other than the scanning lines of the effective display portion, in a retrace period within one frame period.

However, in the method as disclosed in the foregoing publication No. 2585463/1996, for example, when the effective display portion is positioned on the bottom of the display area (display screen), all areas are scanned normally and it fails to solve the foregoing problems. Further, while this publication teaches simultaneously scanning a plurality of scanning lines, other than the scanning lines in the effective display area, its purpose is to simplify the circuits when the number of horizontal lines in a vertical period (the number of horizontal counts in a vertical period) is smaller than the number of scanning lines of the display device, and it is not for realizing lower power consumption, and, in fact, the publication is silent as to operation for realizing lower power consumption. Thus, lower power consumption is not achieved. Further, the publication does not take into consideration the case where the number of horizontal lines in a vertical period (the number of horizontal counts in a vertical period) is larger than the number of scanning lines in the display device. Further, the foregoing publication is totally silent as to preventing flicker on the screen.

SUMMARY OF THE INVENTION

It is an object of the present invention to provide a display device driving circuit, a driving method of a display device, and an image display device, which can reduce power consumption of partial display driving by setting a non-image area which is scanned entirely, for example, within one horizontal period or two horizontal periods, so as to reduce output time of a source driver, which consumes more power than other electric circuitry, and provide a time period in which an operation of a logic system of the source driver is deactivated. It is also an object of the present invention to provide a display device driving circuit, a driving method of a display device, and an image display device, which can prevent flicker on a screen.

In order to achieve the foregoing objects, a display device driving circuit of the present invention includes a scanning signal line driving section for outputting display scanning signals based on display data respectively to scanning signal lines for displaying an image according to the display data with respect to pixels which are disposed in a matrix, and the display device driving circuit comprises: a control section for controlling the output of the display scanning signals from the scanning signal line driving section to the respective scanning signal lines, so that the display scanning signals are outputted simultaneously with respect to the plurality of scanning signal lines based on a transition instruction signal for causing a transition from successive output to simultaneous output with respect to the output of the display scanning signals to the respective scanning signal lines.

In order to achieve the foregoing objects, a driving method of a display device of the present invention is for driving a display device which outputs display scanning signals respectively to scanning signal lines based on display data, and outputs display data signals respectively to data signal lines based on the display data, so as to display an image which is in accordance with the display data with respect to pixels which are disposed in a matrix, and has a partial display function for a non-image area and an image display area, wherein the display scanning signals and the display data signals according to the non-image area are simultaneously outputted with respect to the respective scanning signal lines and the respective data signal lines which correspond to the non-image area.

In order to achieve the foregoing objects, a driving method of a display device of the present invention is for driving a display device which outputs display scanning signals respectively to scanning signal lines based on display data, and outputs display data signals respectively to data signal lines based on the display data, so as to display an image which is in accordance with the display data with respect to pixels which are disposed in a matrix, and has a partial display function for a non-image area and an image display area, wherein the display scanning signals are outputted simultaneously with respect to the plurality of scanning signal lines based on a transition instruction signal for causing a transition of from successive output to simultaneous output with respect to the output of the display scanning signals to the respective scanning signal lines.

In order to achieve the foregoing objects, an image display device of the present invention includes a scanning signal line driving section for outputting display scanning signals respectively to scanning signal lines based on display data, a data signal line driving section for outputting display data signals based on the display data respectively to data signal lines, and a set section for setting an image display area and a non-display area according to the display data with respect to pixels, so as to display an image according to the display data with respect to the pixels which are disposed in a matrix, and the image display device comprises: a scanning signal line control section for controlling the scanning signal line driving section so that the display scanning signals are simultaneously outputted with respect to the respective scanning signal lines which correspond to the non-image area as set by the set section.

In order to achieve the foregoing objects, an image display device of the present invention includes a scanning signal line driving section for outputting display scanning signals respectively to scanning signal lines based on display data, a data signal line driving section for outputting display data signals based on the display data respectively to data signal lines, so as to display an image according to the display data with respect to pixels which are disposed in a matrix, the pixels having a partial display function for an image display area and a non-image area, and the image display device comprises: a scanning signal line control section for controlling the output of the display scanning signals from the scanning signal line driving section to the respective scanning signal lines, so that the display scanning signals are outputted simultaneously with respect to the plurality of scanning signal lines based on a transition instruction signal for causing a transition from successive output to simultaneous output with respect to the output of the display scanning signals to the respective scanning signal lines.

With the foregoing arrangements and methods, for example, the non-image area displays a monochromatic color, for example, white, and thus by outputting the display scanning signals simultaneously to the plurality of scanning signal lines (respective scanning signal lines), monochromatic colors can be displayed on the non-image area. Here, the non-image area is displayed simultaneously, which makes it possible to provide a time for deactivating the scanning signal line driving section, thereby reducing power consumption in the scanning signal line driving section and, in turn, the total power consumption.

For a fuller understanding of the nature and advantages of the invention, reference should be made to the ensuing detailed description taken in conjunction with the accompanying drawings.

DESCRIPTION OF THE EMBODIMENTS

The following will describe one embodiment of the present invention with reference to FIG. 1 through FIG. 6.

Note that, the following explanations are based on the case where a partial display function according to the present invention for performing display by the divided non-image area ("non-display portion" hereinafter) and image display area ("display portion" hereinafter) is set to have a solid white non-display portion. The present invention, however, can also be realized by solid images of other solid monochromatic colors, for example, by solid black.

Figure 2:
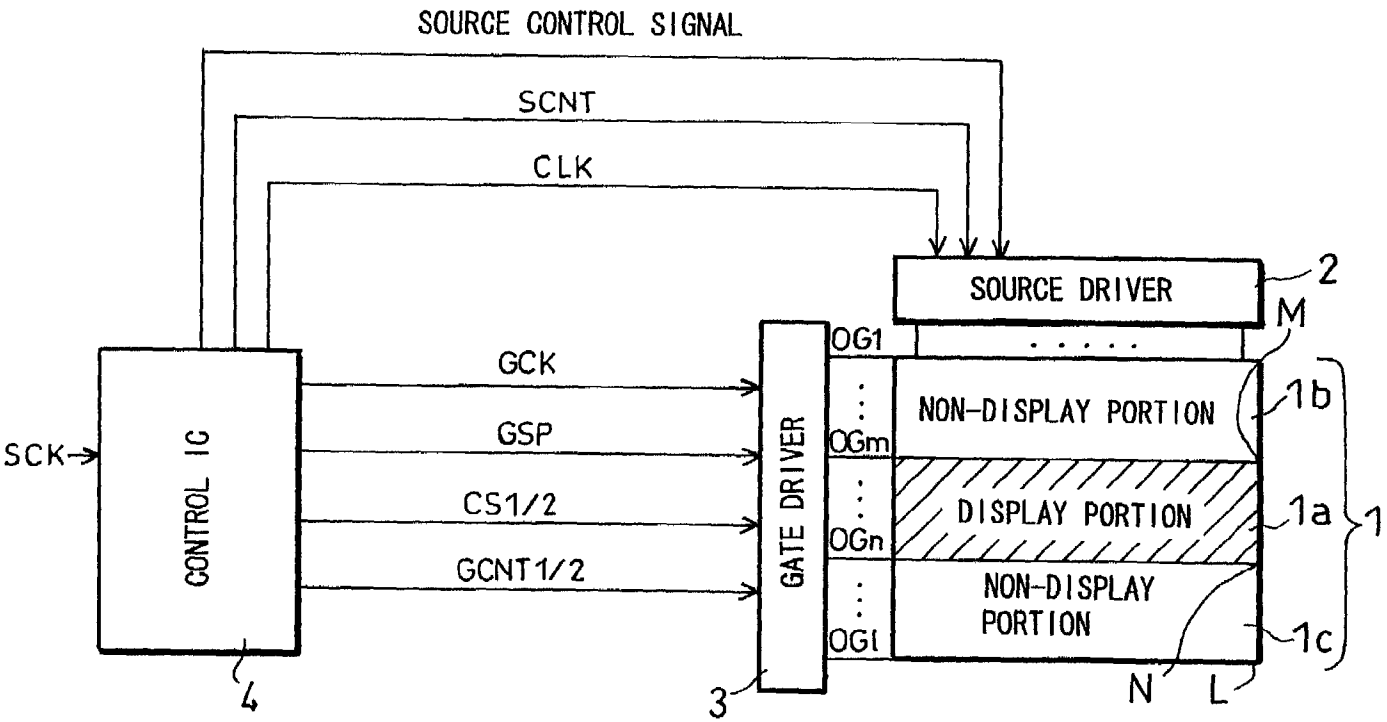
FIG. 2 is a block diagram showing a circuit structure of a liquid crystal display device having the gate driver.

A liquid crystal display device as a display device in accordance with the present invention includes, as shown in FIG. 2, a liquid crystal panel 1, a source driver (data signal line driving section) 2 for driving respective data signal lines of the liquid crystal panel 1, a gate driver (display device driving circuit, scanning signal line driving section) 3 for driving respective scanning signal lines of the liquid crystal panel 1, and a control IC 4 (control means) for controlling the source driver 2 and the gate driver 3 so as to display an image based on display data on the liquid crustal panel 1.

The control IC 4, in receipt of display data (e.g., image data) which are stored in a memory (not shown; e.g., image memory) inside a computer, distributes a source control signal, a source clock signal SCK, and an SCNT signal to the source driver 2, and a gate start pulse signal GSP, a gate clock signal GCK, a CS1/2 signal, and a GCNT1/2 signal, which are gate control signals, to the gate driver 3. These signals are all synchronized.

The liquid crystal panel 1 has data signal lines and scanning signal lines which are orthogonal to each other in a lattice form, and a liquid crystal layer is provided to make up pixels in a matrix pattern between intersections of the data signal lines and scanning signal lines.

The source driver 2 includes shift registers, corresponding to respective data signal lines, and holds serial display data by converting it by the shift registers to parallel display data signals (video signals) based on a clock signal CLK from the control IC 4 which also functions as data signal line control means, and the source driver 2 outputs the converted parallel display data signals simultaneously to the respective data signal lines with horizontal synchronize signals (horizontal period).

Further, the source driver 2 includes operational amplifiers as buffers in respective output stages of the shift registers. The operational amplifiers are provided to reduce or match the output impedance of the display data signals which are outputted from the source driver 2 to the respective data signal lines, and to stabilize an output voltage thereof.

The gate driver 3 applies ON signals (display scanning signals) to respective pixels on the scanning signal lines, for example, line by line from the top, with respect to the scanning signal lines based on a gate start pulse signal GSP which is synchronized with a vertical synchronize signal included in the display data, and a gate clock signal GCK which is synchronized with a horizontal synchronize signal.

Figure 1:
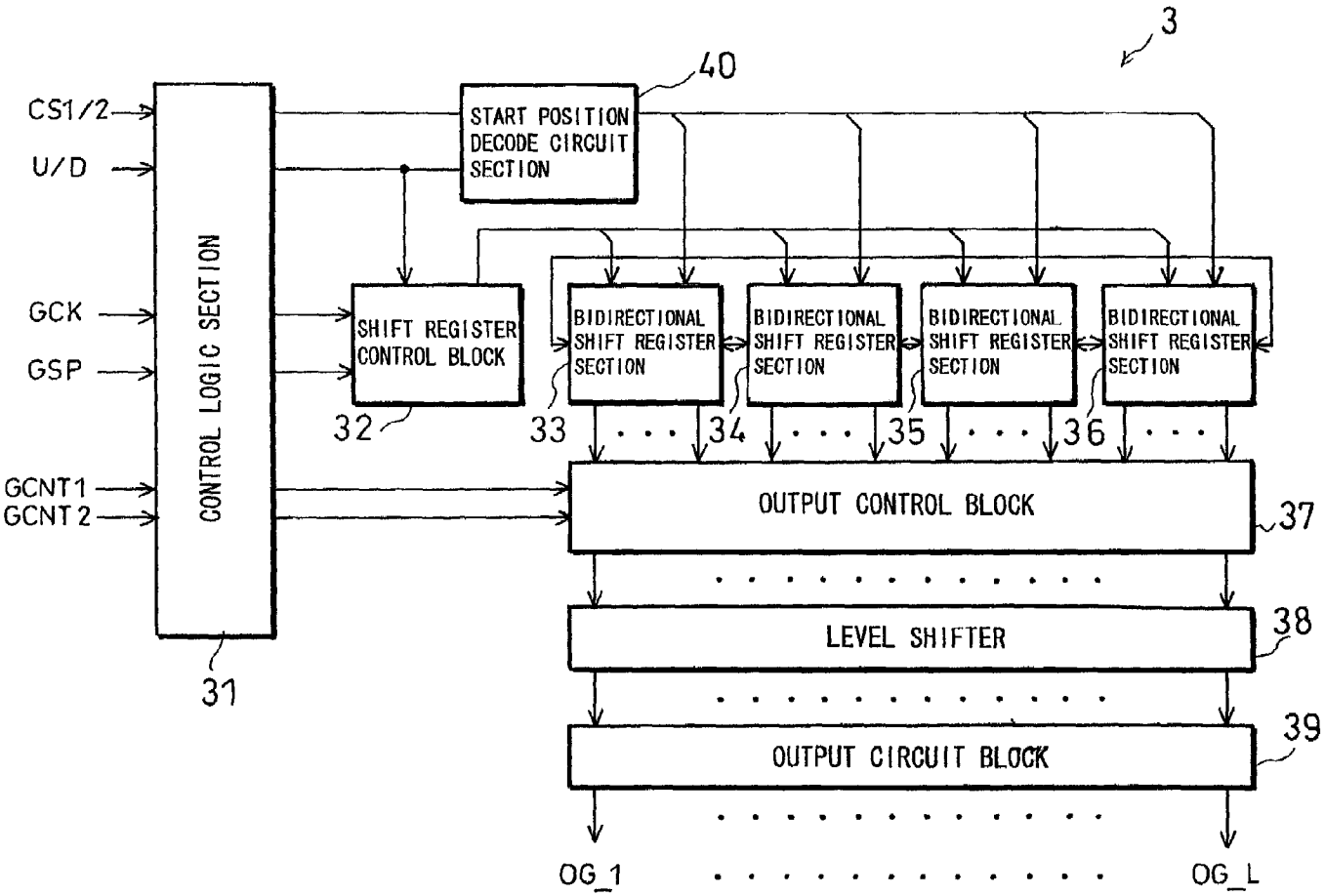
FIG. 1 is a block diagram showing a circuit structure of a gate driver of the present invention.

The following explains an exemplary circuit of the gate driver 3 in detail. As shown in FIG. 1, the gate driver 3 includes a control logic section 31, a shift register control block 32, and a plurality of, for example, four, bidirectional shift register sections 33 through 36 (scanning signal line driving section, shift register section, shift register).

The control logic section 31 functions as control means for controlling a partial display state for performing display by dividing a display screen of the liquid crystal panel 1 into non-display portions 1*b* and 1*c* and a display portion 1*a* along the lengthwise direction of the data signal lines (vertical direction in the display screen of the liquid crystal panel 1) by controlling driving of the gate driver 3, and controls, based on the respective signals outputted from the control IC 4, the shift register control block 32 and the bidirectional shift register sections 33 through 36, and also an output control block 37 (control means (control section), scanning signal line control means (scanning signal line control section)) and a start position decode circuit section 40, etc.

Specifically, the control logic section 31 supplies the gate clock signal GCK, which was supplied from the control IC 4, to the bidirectional shift register sections 33 through 36 via the shift register control block 32, and outputs reset signals to the respective bidirectional shift register sections 33 through 36 via the shift register control block 32 based on the gate start pulse signal GSP, which was supplied from the control IC 4, and starts output of the scanning pulse signals for outputting the ON signals with respect to the respective scanning signal lines, based on the gate start pulse signal GSP and the gate clock signal GCK.

As a result, the shift register control block 32, signaled by the gate start pulse signal GSP from the control logic section 31, starts scanning the scanning signal lines, and outputs the scanning pulse signals for outputting the ON signals to the respective scanning signal lines (e.g., a pulse which changes from High level to Low level and subsequently to High level), from the bidirectional shift register sections 33 through 36 to the respective signal lines according to the gate clock signal GCK.

When the number of scanning signal lines is, for example, 240, the bidirectional shift register sections 33 through 36 each has 60 shift registers (mentioned later), corresponding to the number of scanning signal lines, and, by being serially connected, output the scanning pulse signals to the output control block 37 (mentioned later) at a timing based on the gate clock signal GCK.

The gate driver 3 further includes the output control block 37 which receives the scanning pulse signals respectively from the bidirectional shift register sections 33 through 36, a level shifter 38 for adjusting respective output voltage levels from the output control block 37 to the ON signals for the scanning signal lines, and an output circuit block 39 having the operational amplifiers for optimizing output conditions, such as adjustment of output impedance or output current values, with respect to respective ON signals from the level shifter 38.

The output control block 37 outputs the respective scanning pulse signals from the bidirectional shift register sections 33 through 36 stably as pulse signals of High level, and, after outputting the pulse signals of High level, stably holds the signals, for example, at Low level and outputs the low level signals until reset signals are inputted.

Figure 3:
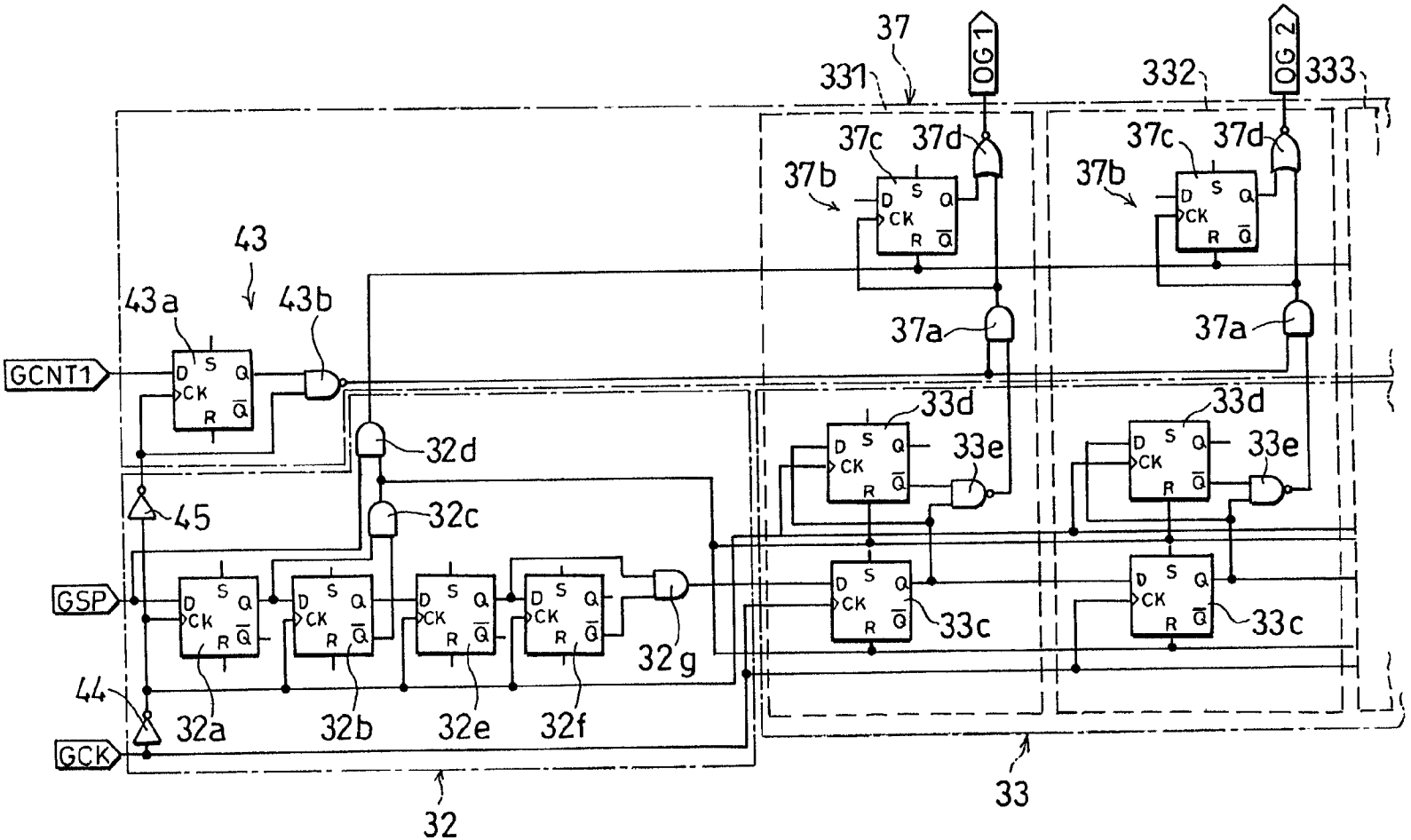
FIG. 3 is a block diagram showing a main circuit structure of the gate driver.

Thus, as shown in FIG. 3 for example, the output control block 37 has an output pulse control section 37*b* composed of a D-flip-flop 37*c* and an NOR circuit 37*d*, for each scanning signal line. To a CK terminal of the D-flip-flop 37*c* is normally inputted a High level signal all the time, and a VDD signal, which is also a High level signal, is inputted to a D terminal of the D-flip-flop 37*c*. Further, the output of a Q terminal of the D-flip-flop 37*c* is set to a Low level by a reset signal.

To a first input terminal of the NOR circuit 37*d* is inputted the output of the Q terminal of the D-flip-flop 37*c*, and to a second input terminal of the NOR circuit 37*d* is inputted signals from the bidirectional shift register sections 33 through 36.

The output control block 37 normally receives High level signals from the bidirectional shift register sections 33 through 36, and therefore the output of the NOR circuit 37*d* remains Low level.

Meanwhile, in this output control block 37, upon input of the scanning pulse signals, which once become Low level and immediately returns to High level, from the bidirectional shift register sections 33 through 36, the NOR circuit 37*d* outputs a High level signal according to the scanning pulse signals.

That is, in the D-flip-flop 37*c*, the output of the Q terminal changes to High level at the fall of the scanning pulse signal (at the rise of the output of an AND circuit 37*a* which will be described later), and utilizing the time lag of this change, the NOR circuit 37*d* outputs a High level signal according to the scanning pulse signal, since the first and second input terminals of the NOR circuit 37*d* become Low level while the AND circuit 37*a* is at Low level.

Subsequently, the first input terminal of the NOR circuit 37*d* receives a High level signal all the time from the Q terminal until a reset signal is supplied to the D-flip-flop 37*c*, and thus the output of the NOR circuit 37*d* remains Low level.

In this kind of liquid crystal display device, the respective pixels of the liquid crystal panel 1 are set normally by respective scanning signal lines which are selected line by line within one frame period (pulse interval of a vertical synchronize signal, e.g., 60 Hz), and the scanning signal lines which are supplied with the ON signals and the respective data signal lines which receive display data signals based on the display data allow an image based on the display data to be displayed on charged pixels and uncharged pixels by blocking or allowing the passage of light through the liquid crystal layer of the pixels.

Further, the foregoing liquid crystal display device includes a set section for setting the display portion and the non-display portion according to the display data on the pixels, and, as shown in FIG. 2 for example, has a partial display function for displaying an image by dividing the display screen of the liquid crystal panel 1 into the non-display portions 1*b* and 1*c* and the display portion 1*a*, along the lengthwise direction of the data signal lines (up-down direction in the display screen of the liquid crystal panel (vertical direction, row direction)). Thus, the liquid crystal display device has the non-display portions 1*b* and 1*c* and the display portion 1*a* which are partitioned in the direction of the scanning signal lines, i.e., in the column direction. Note that, FIG. 2 shows an example where the display portion 1*a* is placed between the non-display portions 1*b* and 1*c*, but the division may be made to have the non-display portion 1*b* and the display portion 1*a*, or the display portion 1*a* and the non-display portion 1*c*. The display portion and the non-display portions are set in advance by the control IC 4 (set section), and they are recognized based on this setting.

Figure 6:
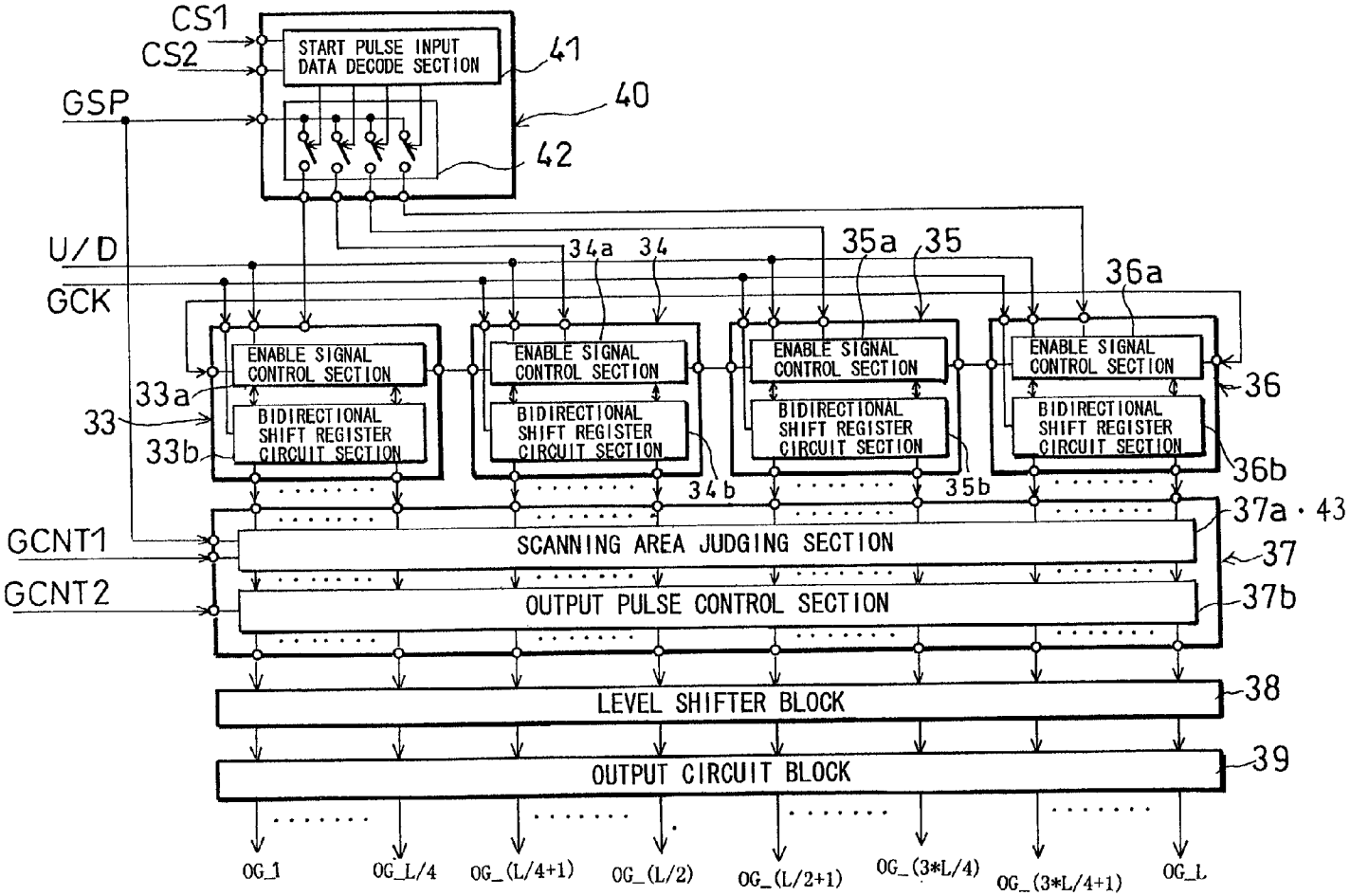
FIG. 6 is a block diagram showing a modification example of the gate driver.

In order to realize this partial display function, the gate driver 3 includes, as shown in FIG. 1, the start position decode circuit section 40 between the control logic section 31 and the respective bidirectional shift register sections 33 through 36, and as shown in FIG. 3 and FIG. 6, the output control block 37 includes an input section (input means) 43 for outputting the ON signals simultaneously, and AND circuits (control means (scanning signal line control means) 37*a*, which are provided as a scanning area judging section (area judging section).

The source driver 2 includes, though not shown, source driver deactivating means (first deactivating means) for deactivating the operation of the source driver 2 until scanning of the display portion 1*a* is started after display signals for the non-display areas 1*b* and 1*c* are once outputted thereto, or until the next input of the gate start pulse signal GSP (synchronize signal (vertical synchronize signal), scanning start signal).

Such source driver deactivating means may be, for example, means for deactivating the supply of the clock signal CLK by a source control signal, etc., on the output side of the clock signal CLK of the source driver 2, in the source driver 2 or the control IC 4. Further, the source driver deactivating means may be realized, for example, by means which operates to deactivate the input of the clock signal CLK into the source driver 2 for an arbitrary period by inputting the clock signal CLK to the first terminal of the AND circuit and by inputting High level normally to the second terminal and Low level when deactivating.

The gate driver 3 also includes gate driver deactivating means (deactivating means, second deactivating means), similar to the source driver deactivating means, which is controlled, for example, by a GCNT2 signal, which is a deactivating signal. The GCNT2 signal is inputted, for example, into the output pulse control section 37*b* of the output control block 37, and the output pulse control section 37*b* deactivates the operation of the bidirectional shift register sections 33 through 36 based on the gate start pulse signal GSP, which is a synchronize signal for displaying an image, and a gate control signal GCNT1, which is a transition instruction signal. That is, the output pulse control signal 37*b* also functions as the deactivating means (second deactivating means) for deactivating the operation of the bidirectional shift register sections 33 through 36 based on the GCNT2 signal. In other words, the bidirectional shift register sections 33 through 36 are deactivated by the control of the output pulse control section 37*b* based on the GCNT2 signal.

Further, the start position decode circuit section 40 controls the start of scanning the bidirectional shift register sections 33 through 36 by the CS1/2 signal and a U/D signal, which are control signals, with respect to the respective bidirectional shift register sections 33 through 36 (whether to input an enable signal by the gate start pulse signal GSP to which of the bidirectional shift register sections 33 through 36). The start position decode circuit section 40 may deactivate supply of the gate clock signal GCK in any of the bidirectional shift register sections 33 through 36 so as to deactivate the operations of subsequent bidirectional shift register sections 33 through 36.

Further, the start pulse decode circuit section 40 is also deactivating means (second deactivating means) for selecting only required bidirectional shift register sections 33 through 36 by ON/OFF of the reset signals or gate clock signal GCK, i.e., operating only required bidirectional shift register sections 33 through 36, so as to deactivate the operations of the other bidirectional shift register sections 33 through 36, for example, by deactivating the output of the gate clock signal GCK (fixing it at High level or Low level). The U/D signal is, for example, for switching the scanning direction of the bidirectional shift register sections 33 through 36.

Figure 4:
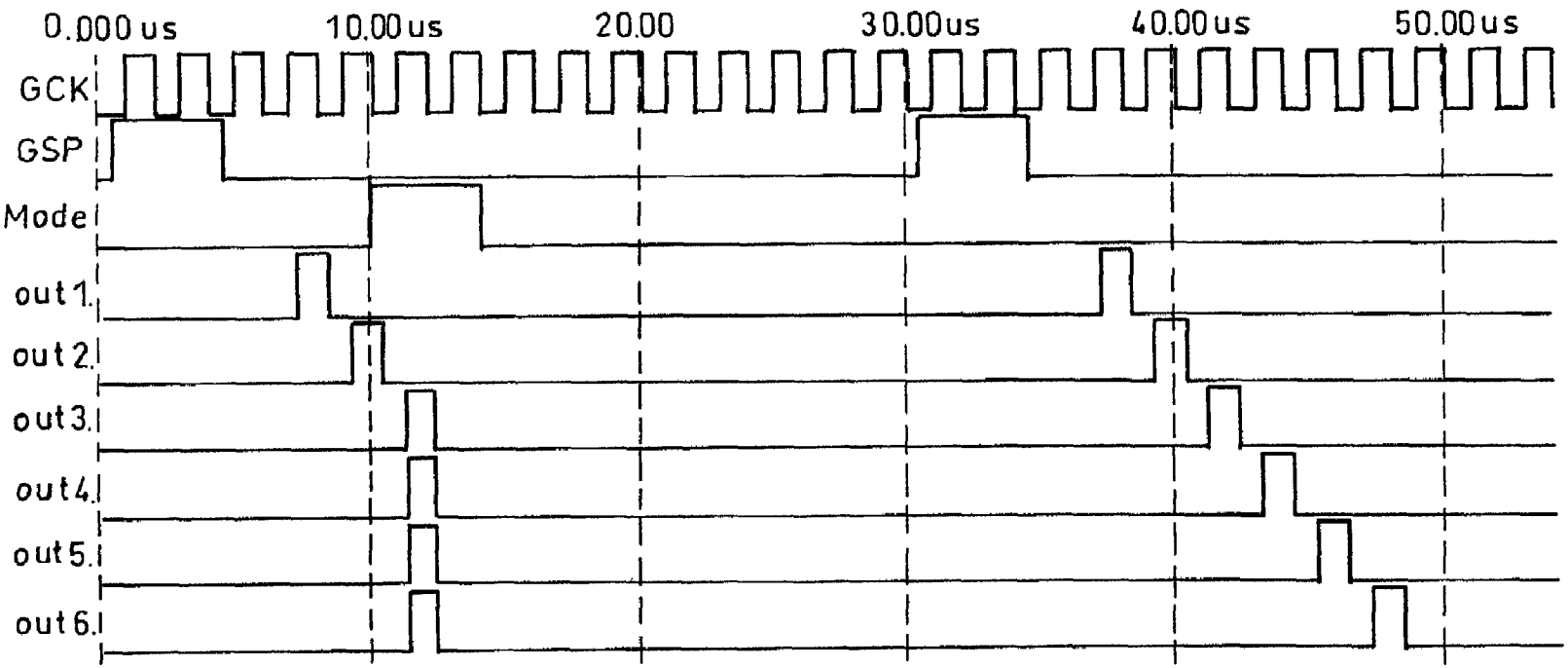
FIG. 4 is a timing chart showing output timings of simultaneous output (one horizontal period) and successive output in the gate driver.

In this gate driver 3, from the control logic section 31 to the input section (input means) 43 is inputted the gate control signal GCNT1, which is a mode signal (transition instruction signal) which is used to make a transition from successive output to simultaneous output with respect to the output of ON signals to the respective scanning signal lines, and more specifically, the output of ON signals to the respective scanning signal lines in the non-display portions 1*b* and 1*c*, and which instructs simultaneous output of ON signals to the respective scanning signal lines in the non-display portions 1*b* and 1*c*, and the input section 43 generates a pseudo scanning pulse signal, similar to the scanning pulse signal (pulse signals which are outputted at the substantially same timing, as shown by out3 and out6 in FIG. 4 (in the vicinity of 10.00 μs in FIG. 4)), based on the input of the gate control signal GCNT1.

The AND circuits 37*a* make up switching means, which, upon input of the pseudo scanning pulse signals or the scanning pulse signals from the respective bidirectional shift register sections 33 through 36, outputs the corresponding pulse signals via the output pulse control section 37*b*, and are provided between the bidirectional shift register sections 33 through 36 and the level shifter 38 (see FIG. 6), and, more specifically, in the output control block 37, corresponding to the respective scanning signal lines.

Thus, the output control block 37, upon input of the gate control signal GCNT1 into the input section 43 from the control logic section 31, acts as control means (scanning signal line control means) for controlling, based on the gate control signal GCNT1, output of the ON signals from the bidirectional shift register sections 33 through 36 to the respective scanning signal lines in such a manner that the ON signals are simultaneously outputted within one horizontal period or two horizontal periods to the plurality of scanning signal lines (e.g., all scanning signal lines of a time frame from the input of the gate control signal GCNT1 to the input section 43 in the output control block 37 to the next successive output, and, more specifically, scanning signal lines in the non-display portions 1*b* and 1*c*, particularly, in an unscanned area in the non-display portions 1*b* and 1*c*).

Further, the output control block 37 includes an unscanned area recognizing section (e.g., scanning area recognizing section as an area recognizing section which is composed of the input section 43, to which the gate control signal GCNT1 is inputted, and the AND circuits 37*a*) for recognizing the unscanned area based on the gate control signal GCNT1, and controls output of the ON signals from the bidirectional shift register sections 33 through 36 to the respective scanning signal lines so that the ON signals are outputted simultaneously only to the scanning signal lines which correspond to the unscanned area as recognized by the unscanned area recognizing section.

That is, the input section 43 and the AND circuits 37*a* are used as a circuit for recognizing a portion which corresponds to an unscanned portion as an unscanned area, (e.g., a terminal which has not outputted a voltage for switching ON a switching element in the liquid crystal display element) within one horizontal period of the gate driver 3, which is the scanning line driver. The scanned area and the unscanned area are recognized, for example, when a user performs partial display, whereby a command which indicates the end of a video signal for partial display is inputted to the control IC 4 by the set section, so as to control the output of the GCNT1 signal or video signal from the control IC 4 based on this command.

In this gate driver 3, by the output control block 37, and more specifically, by the provision of the input section 43 and the AND circuits 37*a*, the ON signals are outputted simultaneously from the gate driver 3 with respect to the respective scanning signal lines which correspond to the non-display portions 1*b* and 1*c*, which are the unscanned area as decided (recognized) by the GCNT1 signal making up the mode signal, and the display data signals for the non-display portions 1*b* and 1*c* are outputted once from the source driver 2 to the respective data signal lines, thus realizing monochromatic display of, for example, white by a single scan over the entire area of the non-display portions 1*b* and 1*c* of the liquid crystal panel 1.

Further, in the case where the scanning signal lines which correspond to the non-display portions 1*a* and 1*b* making up the unscanned area are divided into a first line group and a second line group of, for example odd line numbers and even line numbers, respectively, to simultaneously scan each of the first line group and the second line group by simultaneously outputting the ON signals respectively to the first line group and the second line group based on the GCNT1 signal, the scanning can be realized, for example, by controlling the circuit as shown in FIG. 3 according to the first line group and the second line group of, for example, odd line numbers and even line numbers, respectively.

Further, the scanning signal lines which correspond to the non-display portions 1*a* and 1*c*, making up the unscanned area, may be divided into groups of odd pairs and even pairs of horizontal lines, for example, into a group of scanning signal lines (first line group) including a first pair (first line, second line), a third pair (fifth line, sixth line), . . . and so on, and a group of scanning signal lines (second line group) including a second pair (third line, fourth line), a fourth pair (seventh line, eighth line), . . . and so on, so as to output the ON signals simultaneously respectively to the first line group and the second line group based on the GCNT1 signal. Further, the ON signals may be outputted simultaneously per scanning signal lines which are controlled by a single output circuit.

In this manner, the scanning signal lines which correspond to the non-display portions 1*b* and 1*c*, making up the unscanned area, are divided into the first line group and the second line group, each of which is scanned simultaneously, thus inverting the polarity of the applied voltage to the liquid crystal per single scanning line or two scanning lines. For example, when the first line group and the second line group are odd line group and even line group, respectively, the polarity of the applied voltage to the liquid crystal can be changed per single horizontal line.

In this manner, according to the present embodiment, for example, by scanning the entire unscanned area per two horizontal periods at most, the polarity of the voltage applied to the liquid crystal can be changed per single horizontal line or two horizontal lines, thereby reducing or suitably preventing flicker on the screen.

Further, in the case of simultaneously displaying the display portion 1*a* making up the scanned area, it is preferable that the polarity of a voltage applied to the liquid crystal by the last scanning signal line of the display portion 1*a* be different from the polarity of a voltage applied to the liquid crystal by the first scanning signal line of the non-display portion 1*c* to be scanned simultaneously. This inverts the polarity of the applied voltage to the liquid crystal per single scanning line with respect to all scanning signal lines of the liquid crystal, thus evenly reducing flicker on the screen.

Here, the display data signals for the non-display portions 1*b* and 1*c* are used to charge the respective pixels by applying a voltage to the plurality of pixels with respect to a single data signal line. This might result in deficiency in amount of charge if the duration of voltage application is not different from normally, which, nonetheless, poses no serious problem since it occurs equally in all pixels and thus less color non-uniformity is caused on the non-display portions 1*b* and 1*c*. Nevertheless, in order to secure a sufficient quantity of charge for the pixels in the non-display portions 1*b* and 1*c*, the display data signals may be applied to the respective pixels longer than usual, for example, by increasing the cycle time of the source clock SCK for the control IC 4, i.e., by decreasing the frequency, so as to increase the pulse width of the gate clock signal GCK.

Further, in the foregoing arrangement, once the source driver 2 outputs the display data signals for the non-display portions 1*b* and 1*c*, the output, i.e., operations (processes) of the source driver 2 or the gate driver 3 can be deactivated until the next display portion 1*a* is displayed, i.e., until the next successive output of the ON signals is started, thus reducing power consumption conveniently. That is, in this liquid crystal display device, under normal display of the liquid crystal panel 1, 70 percent to 80 percent of the power consumed by the liquid crystal panel 1 is consumed by the operational amplifiers of the source driver 2, and therefore, by providing the time in which the operation of the source driver 2 is deactivated, it is ensured that the power consumption is further reduced than conventionally even when the partial display function is employed.

The following will describe an operation of the liquid crystal display device using the gate driver 3 of the present invention based on an example, as shown in FIG. 2, wherein the partial display driving is carried out from the Mth output terminal to the Nth output terminal of the liquid crystal panel 1 when the number of scanning signal lines and the number of output terminals (number of scanning signal lines) of the gate driver 3 of the liquid crystal panel 1 are L (where L is a positive integer).

The start position decode circuit section 40 of the gate driver 3 has the function of selecting the four bidirectional shift register sections 33 through 36 by the CS1/2 signal, and thus the output starting position of the gate driver 3 can be set per L/4 lines. In this case, the output starting position of the gate driver 3 can be set by calculating a natural number a from the equation $$a \times L \div 4 < M < (a+1) \times L \div 4$$

and from the [(a×L÷4)+1]th position based on the calculated value of a, i.e., per bidirectional shift register sections 33 through 36. In other words, the output starting position can be set from the first scanning signal line of each of the bidirectional shift register sections 33 through 36. Specifically, when L=240 and M=100, a becomes 1, and thus the output starting position of the gate driver 3 is the 61st position, i.e., from the bidirectional shift register 34.

Figure 5:
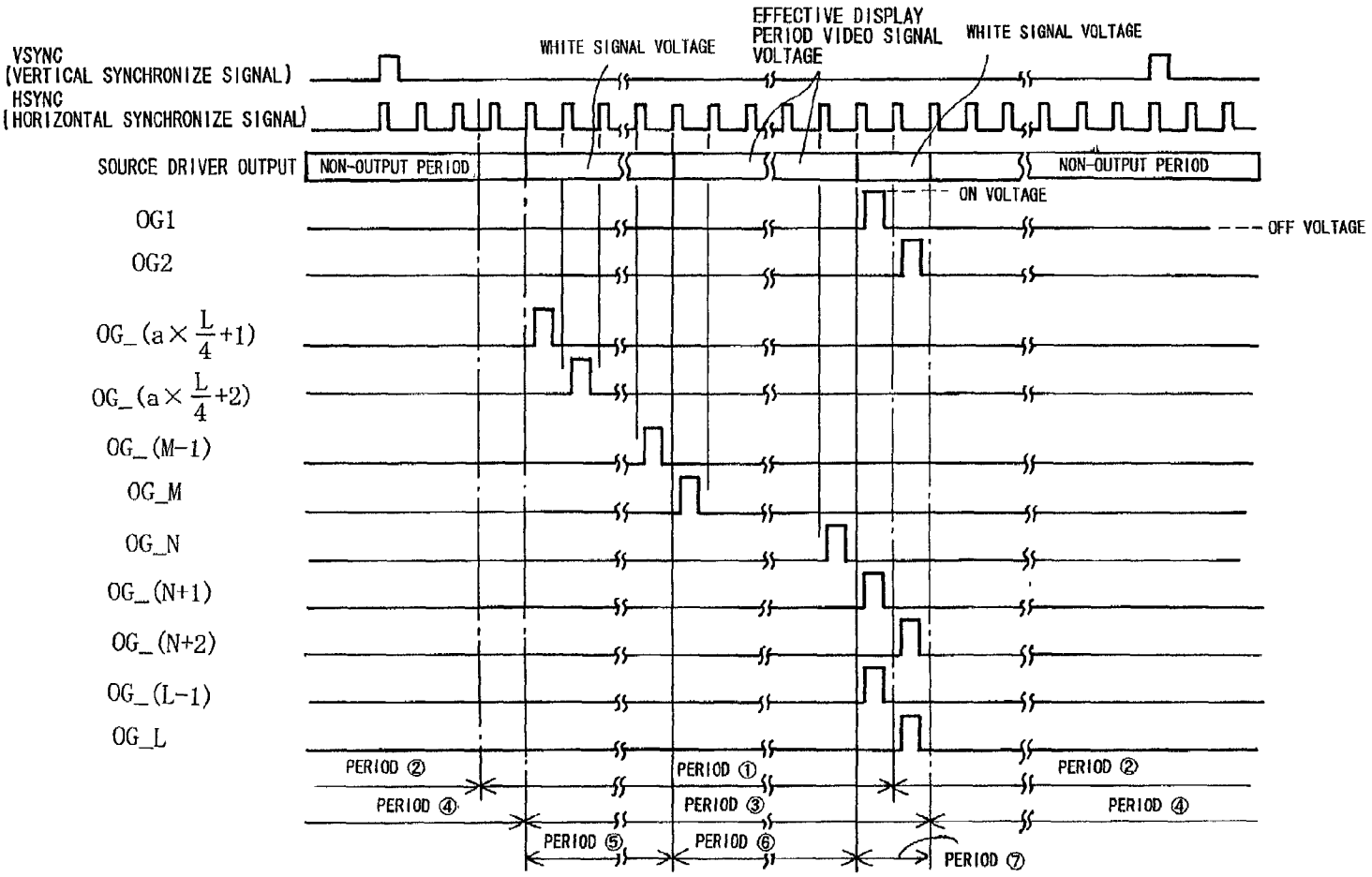
FIG. 5 is a timing chart showing output timings of simultaneous output (two horizontal periods) and successive output in the gate driver.

Here, as shown in FIG. 4 and FIG. 5, from the [(a×L÷4)+1]th position to the Nth position is scanned by the count-up of the bidirectional shift register 34 in the gate driver 3 per one horizontal period as normally done. However, since from [(a×L÷4)+1]th position to the (M−1)th position is the non-display portion 1*b*, the output from the source driver 2 becomes a voltage of white display. FIG. 4 shows an example of outputting the ON signals simultaneously to the respective scanning signal lines of the non-display portions 1*b* and 1*c* within one horizontal period, and FIG. 5 shows an example of outputting the ON signals simultaneously to the respective scanning signal lines of the non-display periods 1*b* and 1*c* within two horizontal periods.

After scanning to the Nth position is finished, by the gate control signal GCNT1, which is the mode signal, and with respect to the terminals of the gate driver 3 which have not made the output, all the odd output terminals output ON pulses simultaneously within one horizontal period, and all the even output terminals output ON pulses simultaneously in the next one horizontal period (see FIG. 5). FIG. 5 shows the case where all bidirectional shift register sections 33 through 36 which are included in the non-display portions 1*b* and 1*c*, for example, the bidirectional shift register sections 33 and 36, are scanned by all scanning signal lines by being simultaneously switched ON thereby.

Periods ① through ⑦ in FIG. 5 indicate the following. Period ① indicates the time required for the sampling operation of the source driver 2 (operation of converting serial display data into a parallel display data signal and holding it). Period ② indicates deactivation of the sampling operation of the source driver 2. Period ③ indicates the time required for the output operations of the source driver 2 and the gate driver 3. Period ④ indicates deactivation of the output operation of the source driver 2 and/or a fixed period of OFF output of the gate driver 3. Period ⑤ indicates a period of applying a white signal voltage by the source driver 2 in the non-display portion 1*b*. Period ⑥ indicates a period of applying the display data signal (video signal in an effective display period) by the source driver 2 in the display portion 1*a*. Period ⑦ indicates a period of applying a white signal voltage simultaneously to an unscanned portion of the non-display portion 1*b*, and to the non-display portion 1*c*.

The output of the source driver 2 is also a voltage for white display in the two horizontal periods, and the image persistence of the liquid crystal layer or display flicker on the respective pixels of the liquid crystal panel 1 is prevented by inverting the applied voltage, i.e., by AC driving. In cases where the phenomenon of image persistence needs not be taken into consideration, as shown in FIG. 4, the ON signals are outputted to all scanning signal lines which correspond to the non-display portions 1*b* and 1*c* within one horizontal period so that the output of the source driver 2 becomes a voltage of white display.

Subsequently, until display of the next frame is started, the SCNT signal (see FIG. 2) is controlled and the output of the source driver 2 is deactivated, and the output of the gate driver 3 is set to a fixed state OFF by the GCNT2 signal, and the operations of the logic parts of the gate driver 3 and the source driver 2 are deactivated. As a result, the operation time of the source driver 2 and the gate driver 3 becomes (N−a×L÷4+1)÷L, when they are switched ON simultaneously in one horizontal period, and (N−a×L÷4+2)÷L, when they are switched ON simultaneously in two horizontal periods, thus reducing power consumption.

Further, it is required in the display portion 1*a* that the application period (refresh rate) of the display data signal (video signal) for the liquid crystal layer of the liquid crystal panel 1 be a period which depends on the content of the display (e.g., at least a period of 60 Hz is required when displaying a moving image in accordance with the NTSC [National Television System Committee: 525 scanning lines and 30 frames per second]), and the non-display portions 1*b* and 1*c* are fixed to solid white display, as in the present embodiment, which allows the refresh rate to be lower than the frequency of the display portion 1*a*, thereby reducing power consumption and stabilizing display operation. Namely, by having different application periods (refresh rates) for the display data signal (video signal) between the display portion 1*a* and the non-display portions 1*b* and 1*c*, power consumption can be reduced and display operation can be stabilized.

That is, in the foregoing liquid crystal display device, the clock signal (first clock signal) for displaying the display portion 1*a* may be different from the clock signal (second clock signal) for displaying the non-display portions 1*b* and 1*c*. This allows the clock signal for displaying the non-display portions 1*b* and 1*c* to have a lower frequency than the clock signal for displaying the display portion 1*a*, thus further reducing power consumption, and stabilizing display operation by the lower frequency. In other words, it is preferable in driving the liquid crystal display device that the frequencies of the ON signals are different between the successive output and the simultaneous output with respect to the scanning signal lines.

It should be noted however that the polarity of the applied display data signal (video signal) needs to be opposite to that of the previous display data signal. Further, when reducing the frequency of the non-display portions 1*b* and 1*c*, the frequency is set within a range which does not cause image persistence or flicker on the screen due to polarization of each liquid crystal layer of the liquid crystal panel 1.

Therefore, in the gate driver 3, even in the case where there exist the display portion 1*a* and the non-display portion 1*b* in a single bidirectional shift register section, there are provided the serially connected bidirectional shift register sections 33 through 36 which output ON signals to the respective scanning signal lines, and a plurality of scanning starting positions are set in the vertical direction, i.e., in the up-and-down direction of the screen, whereby the ON signals are successively outputted, among the plurality of scanning starting positions, to the scanning signal lines which correspond to the non-display portion 1*b* of the area from the scanning starting position of the non-display portion 1*b* in the vicinity of a front portion of the display portion 1*a* to the display portion 1*a*, and to the scanning signal lines which correspond to the display portion 1*a*, and the ON signals are outputted simultaneously to the signal scanning signal lines which correspond to the unscanned area based on the gate control signal GCNT1, and the operations of the bidirectional shift register sections 33 through 36 are deactivated until the next successive output is carried out.

That is, when there exist the display portion 1*a* and the non-display portion 1*b* in a single bidirectional shift register section of the plurality of shift register sections 33 through 36, and when this bidirectional shift register section is scanned simultaneously, a display portion of the bidirectional shift register section (a portion of the display portion 1*a*) will be in a non-display state. In order to prevent this, among the plurality of scanning starting positions, the scanning signal lines in the vicinity of the boundary between the display portion 1*a* and the non-display portion 1*b* and which correspond to the non-display portion 1*b* of the area from a scanning starting position on the side of the non-display portion 1*b* to the boundary between the display portion 1*a* and the non-display portion 1*b* are successively scanned in the same manner as the display portion 1*a*, and after successively scanning the display portion 1*a*, the signals are applied simultaneously to scanning signal lines which correspond to an unscanned area from the non-display portion 1*c* after the display portion 1*a* up to the display portion 1*a* of the next frame, or up to scanning signal lines in the vicinity of a boundary between the display portion 1*a* of the next frame and the non-display portion 1*b* and which correspond to a scanning starting position on the side of the non-display portion 1*b*. This allows the operations of the bidirectional shift register sections 33 through 36 to be deactivated after the signal application to the scanning signal lines which correspond to the unscanned area, thereby reducing power consumption. Further, the display portion 1*a* will not be deleted or reduced.

The foregoing explanation described the case where, as shown in FIG. 5, a difference in refresh rate between upper and lower scanning signal lines is prevented in the display portion 1*a* by scanning the respective unscanned areas of the non-display portions 1*b* and 1*c* simultaneously by switching ON only these unscanned areas simultaneously, so as to prevent non-uniform display in the display portion 1*a*. However, in order to further reduce power consumption, for example, in a bidirectional shift register section which at least partially displays the non-display portion 1*b* and the display portion 1*a*, the ON signals may be outputted simultaneously from this bidirectional shift register section to display a monochromatic color on the screen of the liquid crystal panel 1 which corresponds to the bidirectional shift register section, and thereafter the respective scanning signal lines which correspond to the display portion 1*a* of the bidirectional shift register may be scanned at appropriate timings for normal display.

In this way, the deactivation period of the source driver 2 or the gate driver 3 can be extended further, and the power consumption can further be reduced. In this case, the display portion 1*a* is successively supplied at least partially with the display data signals again after once switched ON simultaneously, which, however, may cause a difference in refresh rate between upper and lower scanning signal lines in the display portion 1*a* of the liquid crystal panel 1, and generates a gradient in brightness in the display portion 1*a* of the liquid crystal panel 1. However, when the range of the display portion 1*a* in particular is narrow, there will be no problem concerning visibility in display of the display portion 1*a*.

Note that, the foregoing described the case where the liquid crystal display adopted the active-matrix TFT liquid crystal panel. However, not limiting to this, it is also possible to adopt, for example, a liquid crystal panel of an MIM (Metal-Insulator-Metal) type, or an electroluminescence flat display and the like.

The following will describe the input section 43 in more detail. As shown in FIG. 3, the input section 43 includes a D-flip-flop 43*a* and an NAND circuit 43*b*. To a D terminal of the D-flip-flop 43*a* is inputted the gate control signal GCNT1, and to a CK terminal of the D-flip-flop 43*a* is inputted the gate clock signal GCK in a slightly delayed manner via inverters 44 and 45. The output of a Q terminal of the D-flip-flop 43*a* is inputted to a first input terminal of the NAND circuit 43*b*. To a second input terminal of the NAND circuit 43*b* is inputted the gate clock signal GCK.

Thus, the input section 43 generates the pseudo scanning pulse signal by the gate control signal GCNT1 which becomes, for example, High level. That is, when the gate control signal GCNT1 is at Low level, the output of the Q terminal of the D-flip-flop 43*a* remains Low level, irrespective of Low level or High level of the gate clock signal GCK, and thus the output of the NAND circuit 43*b* becomes High level. On the other hand, when the gate control signal GCNT1 becomes High level, the output of the Q terminal of the D-flip-flop 43*a* changes to High level at the rise of the gate clock signal GCK, and the output of the NAND circuit 43*b* becomes Low level when the gate clock signal GCK is at High level to make the pseudo scanning pulse signal.

Further, the gate control signal GCNT1, which is the mode signal, is normally a pulse signal for maintaining a High level for a duration of about 2 cycles of the gate clock signal GCK at High level, and therefore a single pseudo scanning pulse signal is outputted by the gate control signal GCNT1.

The following describes the shift register control block 32 and the bidirectional shift register sections 33 through 36 in more detail. Note that, since the bidirectional shift register sections 33 through 36 are equivalent and each has circuits of repeating units, only a part of the bidirectional shift register section 33 will be described.

First, the shift register control block 32 includes two D-flip-flops 32*a* and 32*b* and two AND circuits 32*c* and 32*d* for outputting reset signals.

To a D terminal of the D-flip-flop 32*a* is inputted the gate start pulse signal GSP, and to a CK terminal of the D-flip-flop 32*a* is inputted the gate clock signal GCK which was inverted by the inverter 44. To a D terminal of the D-flip-flop 32*b* is inputted an output of a Q terminal of the D-flip-flop 32*a*, and to a CK terminal of the D-flip-flop 32*b* is inputted the gate clock signal GCK which was inverted by the inverter 44.

To a first input terminal of the AND circuit 32*c* is inputted an output of a Q terminal of the D-flip-flop 32*a*, and to a second input terminal thereof is inputted an output of a $\overline{Q}$ terminal of the D-flip-flip 32*b*. Thus, when the gate start pulse GSP is changed from a Low level to a High level, the output of the $\overline{Q}$ terminal of the D-flip-flip 32*b*, after being delayed therein, changes from a High level to a Low level at the time when the output of the Q terminal of the D-flip-flop 32*a* is changed from a Low level to a High level.

Therefore, during the time lag of this change, the input to the respective input terminals of the AND circuit 32*c* becomes High level, and the AND circuit 32*c* outputs pulse signals having a smaller-pulse width than that of the gate start pulse signal GSP as the reset signals to the respective bidirectional shift register sections 33 through 36 in accordance with the gate start pulse signal GSP.

Further, to a first input terminal of the AND circuit 32*d* is inputted the gate start pulse signal GSP, and to a second input terminal thereof is inputted an output from the AND circuit 32*c*. Thus, the AND circuit 32*d* outputs pulse signals, similar to the reset signals, as the reset signals for the output control block 37 in accordance with the gate start pulse signal GSP.

Further, in order to start output of the ON signals line by line in the bidirectional shift register sections 33 through 36, the shift register control block 32 includes two D-flip-flops 32*e* and 32*f* and an AND circuit 32*g*.

To a D terminal of the D-flip-flop 32*e* is inputted an output of a Q terminal of the D-flip-flop 32*b*, and to a CK terminal of the D-flip-flop 32*e* is inputted the gate clock signal GCK which was inverted by the inverter 44. To a D terminal of the D-flip-flop 32*f* is inputted an output of the Q terminal of the D-flip-flop 32*e*, and to a CK terminal of the D-flip-flop 32*f* is inputted an output of the gate clock signal GCK which was inverted by the inverter 44.

To a first input terminal of the AND circuit 32*g* is inputted an output of a Q terminal of the D-flip-flop 32*e*, and to a second input terminal thereof is inputted a $\overline{Q}$ terminal of the D-flip-flop 32*f*. Thus, the AND circuit 32*g* outputs a pulse signal, which became High level by the D-flip-flop 32*b* and the AND circuit 32*c*, as a start signal for the bidirectional shift register section 33. The start signal is outputted by being delayed for a predetermined period via the D-flip-flops 32*e* and 32*f* by the reset signals from the AND circuits 32*c* and 32*d*, thus stabilizing the line by line output of the ON signals from the bidirectional shift register sections 33 through 36 in accordance with the gate clock signal GCK.

The bidirectional shift register section 33 includes two D-flip-flops 33*c* and 33*d* and an NAND circuit 33*e*, so as to output an instruction signal, which is started by the gate clock signal GCK and which causes the line-byline output of the ON signals.

To a D terminal of the D-flip-flop 33*c* is inputted an output of the AND circuit 32*g* (a pulse signal which is normally at Low level and becomes High level according to the gate clock signal GCK), and to a CK terminal thereof is inputted the gate clock signal GCK, and to an R (reset) terminal is inputted an output from the AND circuit 32*c*.

To a D terminal of the D-flip-flop 33*d* is inputted an output of a Q terminal of the D-flip-flop 33*c*, and to a CK terminal thereof is inputted the gate clock signal GCK which was inverted by the inverter 44, and to an R (reset) terminal is inputted an output from the AND circuit 32*c*.

To a first input terminal of the NAND circuit 33*e* is inputted an output of a $\overline{Q}$ terminal of the D-flip-flop 33*d*, and to a second input terminal thereof is inputted an output of a Q terminal of the D-flip-flop 33*c*. Thus, the NAND circuit 33*e* normally outputs High level, and, in receipt of the pulse signal from the AND circuit 32*g*, outputs the instruction signal of a Low level having a pulse width smaller than that of the gate clock signal GCK.

Further, the bidirectional shift register section 33 is provided with shift registers, each of which is composed of the two D-flip-flops 33*c* and 33*d* and the NAND circuit 33*e*, according to the number of scanning signal lines employed (e.g., 60 lines) (indicated by reference numerals 331, 332, 333, . . . in FIG. 3), and the output of the Q terminal of the D-flip-flop 33*c* is inputted into the D terminal of the next D-flip-flop 33*c*, thus successively outputting instruction signals which are outputted line by line and which are for the ON signals, based on the signal delay in the D-flip-flop 33*c*, and the gate clock signal GCK.

Note that, the foregoing described the case of using the start position decode section 40 which selects the bidirectional shift register sections 33 through 36 by ON/OFF of the reset signals or the gate clock signal GCK, using the CS1/2 signal and U/D signal, which are control signals. However, not limiting to this, it is possible alternatively, as shown in FIG. 6, to provide a start pulse input data decode section 41 which outputs the instruction signal for selecting the bidirectional shift register sections 33 through 36 to be selected by the CS1/2 signal in the start position decode section 40, and provide a switching section 42 for connecting or disconnecting the gate clock signal GCK with respect to the respective bidirectional shift register sections 33 through 36 in accordance with the instruction signal.

In this case, the respective bidirectional shift register sections 33 through 36 may be provided with enable signal control sections 33*a* through 36*a* on preceding stages of their bidirectional shift register circuit sections 33*b* through 36*b*, respectively, so as to successively send enable signals (operation starting signals) from the enable signal control sections 33*a* through 36*a* in an effort to send scanning pulse signals for the ON signals without the counter operation.

The enable signal control sections 33*a* through 36*a* are for controlling supply of enable signals to the bidirectional shift register circuit sections 33*b* through 36*b* of the first stage, which are selected in accordance with the shift direction of the bidirectional shift register circuit sections 33*b* through 36*b*, the start position control signals, and the respective CS1/2 signals. By this function the enable signal control sections 33*a* through 36*a* can change the scanning starting position of the bidirectional shift register circuit sections 33*b* through 36*b*, thus reducing the area, within the non-display portions 1*b* and 1*c*, for which a normal scan is required.

As described, the display device driving circuit (e.g., gate driver) in accordance with the present embodiment is a display device driving circuit which includes a scanning signal line driving section (e.g., bidirectional shift register section of gate driver) for outputting display scanning signals (e.g., ON signals) based on display data respectively to scanning signal lines for displaying an image according to the display data with respect to pixels which are disposed in a matrix, and the display device driving circuit comprises control means (e.g., output control block, and specifically, a control section of the control block, etc., having the input section and the AND circuit, and more specifically, input section and AND circuit of the output control block) for controlling the output of the display scanning signals from the scanning signal line driving circuit to the respective scanning signal lines, so that the display scanning signals are outputted simultaneously (e.g., simultaneously within one horizontal period or two horizontal periods) with respect to the plurality of scanning signal lines (e.g., all scanning signal lines from the input of a transition instruction signal to the next successive output, and more specifically, scanning signal lines in a non-image area, particularly, in an unscanned area of the non-image area) based on a transition instruction signal (e.g., gate control signal GCNT1 as a mode signal) for causing a transition from successive output to simultaneous output with respect to the output of the display scanning signals to the respective scanning signal lines.

Further, the image display device in accordance with the present embodiment includes the foregoing display device driving circuit.

The image display device in accordance with the present embodiment is an image display device which includes a scanning signal line driving section (e.g., bidirectional shift register section of the gate driver) for outputting display scanning signals (e.g., ON signals) respectively to scanning signal lines based on display data, a data signal line driving section (e.g., gate driver) for outputting display data signals (e.g., video signals) based on the display data respectively to data signal lines, so as to display an image according to the display data with respect to pixels which are disposed in a matrix, the pixels having a partial display function for an image display area and a non-image area, and the image display device comprises scanning signal line control means (e.g., output control block, and more specifically, control section (scanning signal line control section) of the output control block, etc., having the input section and AND circuit) for controlling the output of the display scanning signals from the scanning signal line driving circuit to the respective scanning signal lines, so that the display scanning signals are outputted simultaneously (e.g., simultaneously within one horizontal period or two horizontal periods) with respect to the plurality of scanning signal lines based on a transition instruction signal (e.g., gate control signal GCNT1 as a mode signal) for causing a transition from successive output to simultaneous output with respect to the output of the display scanning signals to the respective scanning signal lines.

Further, the image display device in accordance with the present embodiment is an image display device which includes a scanning signal line driving section (e.g., bidirectional shift register section of the gate driver) for outputting display scanning signals (e.g., ON signals) respectively to scanning signal lines based on display data, a data signal line driving section (e.g., gate driver) for outputting display data signals (e.g., video signals) based on the display data respectively to data signal lines, and a set section (e.g., control IC) for setting an image display area and a non-display area according to the display data with respect to the pixels, so as to display an image according to the display data with respect to pixels which are disposed in a matrix, and the image display device comprises scanning signal line control means (e.g., output control block, and more specifically, a control section (scanning signal line control section) of the output control block, etc., having the input section and AND circuit) for controlling the scanning signal line driving section so that the display scanning signals are simultaneously (e.g., simultaneously within one horizontal period or two horizontal periods) outputted with respect to the respective scanning signal lines which correspond to the non-image area as set by the set section.

Further, the driving method of a display device in accordance with the present embodiment is a driving method for driving a display device having the foregoing display device driving circuit, i.e., the image display device in accordance with the present embodiment.

The driving method of a display device in accordance with the present embodiment is a method for driving a display device which outputs display scanning signals (e.g., ON signals) respectively to scanning signal lines based on display data, and display data signals (e.g., video signals) respectively to data signal lines based on the display data, so as to display an image which is in accordance with the display data with respect to pixels which are disposed in a matrix, and has a partial display function for a non-image area and an image display area, wherein the display scanning signals are outputted simultaneously (e.g., simultaneously within one horizontal period or two horizontal periods) with respect to the plurality of scanning signal lines based on a transition instruction signal (e.g., gate control signal GCNT1 as a mode signal) for causing a transition from successive output to simultaneous output with respect to the output of the display scanning signals to the respective scanning signal lines.

Further, the driving method of a display device in accordance with the present embodiment is a method for driving a display device which outputs display scanning signals (e.g., ON signals) respectively to scanning signal lines based on display data, and display data signals (e.g., video signals) respectively to data signal lines based on the display data, so as to display an image which is in accordance with the display data with respect to pixels which are disposed in a matrix, and has a partial display function for a non-image area and an image display area, wherein the display scanning signals and the display data signals according to the non-image area are simultaneously (e.g., simultaneously within one horizontal period or two horizontal periods) outputted with respect to the respective scanning signal lines and the respective data signal lines which correspond to the non-image area.

Note that, the unscanned area indicates a portion which corresponds to an unscanned portion in one vertical period (e.g., a terminal which has not outputted an ON voltage for a switching element within the display device of a liquid crystal display device, etc.).

With the foregoing arrangements and methods, for example, the non-image area displays, for example, white, and thus by outputting the display scanning signals simultaneously to the plurality of scanning signal lines (respective scanning signal lines), monochromatic colors can be displayed on the non-image area. Here, the non-image area, for example, an unscanned area in the non-image area, is displayed simultaneously, which makes it possible to provide a time for deactivating the scanning signal line driving section after the simultaneous display, thereby reducing power consumption in the scanning signal line driving section and, in turn, the total power consumption.

In this manner, in the present embodiment, a voltage is applied to the non-image area for a certain period, taking into account reduction in applied charge also in the non-image area, thus reducing power for applying a voltage to the non-image area.

More specifically, the foregoing arrangements and methods are suitably employed by active-matrix liquid crystal display devices having a partial display function where a portion of the screen makes up an image display area and the other portion makes up a non-image area, and the power consumption can be reduced by simultaneously scanning plural lines which correspond to the non-image area (i.e., output of display scanning signals to the scanning signal lines), for example, within one horizontal period or two horizontal periods.

Further, in the present embodiment, instead of scanning the plurality of scanning signal lines in the image display device only in a retrace period, for example, based on the transition instruction signal irrespective of the retrace period or not, the subsequent scanning signal lines are scanned simultaneously and forcibly. Further, the present embodiment can realize lower power consumption not only when the number of horizontal lines in a vertical period is smaller than the number of scanning signal lines in the image display device, but also when the number of horizontal lines in a vertical period is larger than the number of scanning signal lines in the image display device.

In the foregoing display device driving circuit, the scanning signal line driving section preferably includes a plurality of serially connected shift register sections for outputting the display scanning signals respectively to the scanning signal lines.

With this arrangement, by the provision of the plurality of shift register sections, the shift register sections which correspond to the non-image area but nonetheless require a normal scan can be reduced in number, even when the image display area is set differently. In other words, when all scanning signal lines of a single shift register section correspond to the non-image area, the non-image area can be displayed by simultaneously scanning this shift register section, thus reducing the number of shift register sections which belong to the non-image area but nonetheless require a normal scan, and thereby reducing power consumption.

Further, with the foregoing arrangement, by the provision of the plurality of shift register sections, the shift register sections can be scanned individually and simultaneously, or operations thereof can be deactivated, thus ensuring lower power consumption.

The display device driving circuit preferably includes deactivating means for deactivating the operation of the scanning signal line driving section based on a synchronize signal (e.g., gate pulse signal GSP which is synchronized with a vertical synchronize signal) and the transition instruction signal for displaying the image. That is, it is preferable that the display device driving circuit includes deactivating means (e.g., output pulse control section, start position decode circuit section, and other means such as gate driver deactivating means) for deactivating the operation of the scanning signal line driving section until the next scan is started (i.e., until the next successive output of the display scanning signals is carried out). With thus arrangement, lower power consumption can be further ensured by the provision of the deactivating means.

Further, it is preferable in the foregoing display device driving circuit that the control means includes an unscanned area recognizing section (e.g., area judging section having the input section and the AND circuit, to which the transition instruction signal is inputted) for recognizing an unscanned area based on the transition instruction signal, and controls the output of the display scanning signals from the scanning signal line driving section to the respective scanning signal lines so that the display scanning signals are outputted simultaneously only to the scanning signal lines which correspond to the unscanned area as recognized by the unscanned area recognizing section. With this arrangement, it is possible to prevent a difference in refresh rate between upper and lower scanning signal lines, i.e., in the vertical direction, in the image display area, thus preventing non-uniform display therein.

Further, it is preferable in the foregoing display device driving circuit that the scanning signal line driving section has a plurality of scanning starting positions which are set in a vertical direction, and successively outputs, among the plurality of scanning starting positions, the display scanning signals to scanning signal lines which correspond to a non-image area, which is an area from a scanning starting position therein in the vicinity of a front portion of an image display area to the image display area, and to scanning signal lines which correspond to the image display area, and thereafter simultaneously outputs the display scanning signals to scanning signal lines which correspond to an unscanned area based on the transition instruction signal.

Similarly, it is preferable in the driving method of the display device that, among a plurality of scanning starting positions which are set in a vertical direction, the display scanning signals are successively outputted to scanning signal lines which correspond to a non-image area, which is an area from a scanning starting position therein in the vicinity of a front portion of an image display area to the image display area, and to scanning signal lines which correspond to the image display area, and thereafter the display scanning signals are simultaneously outputted to scanning signal lines which correspond to an unscanned area based on the transition instruction signal.

It is preferable in the image display device that the scanning signal line driving section includes a plurality of serially connected shift register sections for outputting the display scanning signals to the respective scanning signal lines and includes a plurality of scanning starting positions which are set in a vertical direction, and, among the plurality of scanning starting positions, successively outputs the display scanning signals to scanning signal lines which correspond to a non-image area, which is an area from a scanning starting position therein in the vicinity of a front portion of an image display area to the image display area, and to scanning signal lines which correspond to the image display area, and thereafter simultaneously outputs, based on the transition instruction signal, the display scanning signals to scanning signal lines which correspond to an unscanned area.

When there exist the image display area and the non-image area in a single shift register section, and when this shift register section is scanned simultaneously, the image display area will be in a non-display state. However, with the foregoing arrangement, a plurality of scanning starting positions are set in the vertical direction, and among the plurality of scanning starting positions, the non-image area, which is an area from a scanning starting position in the non-image area in the vicinity of a front portion of the image display area to the image display area, is successively scanned by successively outputting the display scanning signals, as in the image display area. This allows the shift register sections to be scanned individually either successively or simultaneously, thus reducing the number of shift register sections which belong to the non-image area but nonetheless require a normal scan, without deleting the image display area.

Further, with this arrangement, among the plurality of scanning starting positions, the scanning signal line driving section first outputs the display scanning signals successively to the scanning signal lines which correspond to the non-image area, which is the area from a scanning starting position in the non-image area in the vicinity of a front portion of the image display area to the image display area, and to the image-display area, and then simultaneously outputs the display scanning signals to the scanning signal lines which correspond to the unscanned area. This allows the operation of the device, i.e., the scanning signal line driving section, to be deactivated after the display scanning signals are simultaneously outputted, based on the transition instruction signal, to the scanning signal lines which correspond to the unscanned area and until the next successive output is carried out, thus providing a time for deactivating the scanning signal line driving section after the simultaneous output, and thereby reducing the power consumption in the scanning signal line driving section and, in turn, the total power consumption. Further, by simultaneously outputting the display scanning signals to the scanning signal lines which correspond to the unscanned area, a difference in refresh rate between upper and lower scanning signal lines, i.e., in the vertical direction, can be prevented in the image display area, thus preventing non-uniform display therein.

Therefore, it is preferable in the foregoing driving method of the display device that the operation of the display device is deactivated after simultaneously outputting the display scanning signals only to the scanning signal lines which correspond to the unscanned area and until the next successive output is carried out. Further, it is preferable in the foregoing image display device that the scanning signal line control means controls the output of the display scanning signals from the scanning signal line driving section to the respective scanning signal lines, so as to deactivate the operation of the device after simultaneously outputting the display scanning signals, based on the transition instruction signal, only to the scanning signal lines which correspond to the unscanned area and until the next successive output is carried out. With this arrangement, lower power consumption is further ensured.

Further, it is preferable in the foregoing driving method of the display device that the display scanning signals are outputted to each of the first line group (e.g., a group of add numbered lines, or a group of odd pairs of horizontal lines) and the second line group (e.g., a group of even numbered lines, or a group of even pairs of horizontal lines) of the scanning signal lines which correspond to the unscanned area. It is preferable in the image display device that the scanning signal line control means controls the output of the display scanning signals from the scanning signal line driving section to the respective scanning signal lines so that the display scanning signals are simultaneously outputted to each of the first line group and the second line group of the scanning signal line which correspond to the unscanned area. With this arrangement, since the display scanning signals are simultaneously outputted to each of the first line group and the second line group of the scanning signal lines which correspond to the unscanned area, the polarity of a voltage applied on the non-display area can be inverted per one scanning line (one horizontal line) or per two scanning lines (two horizontal lines), thus suppressing flicker on the screen.

Further, it is preferable in the foregoing driving method of the display device that the frequencies of the display scanning signals are different between successive output and simultaneous output of the display scanning signals with respect to the scanning signal lines. With this arrangement, the frequency of the display scanning signals at the simultaneous output of the display scanning signals can be made lower than that of the display scanning signals at the successive output of the display scanning signals, thus further ensuring lower power consumption and stabilizing display operation by the lower frequency.

Further, it is preferable that the foregoing image display device includes the data signal line control means (e.g., control IC) for controlling the data signal line driving section so that the display data signals for the non-image area are outputted to the respective data signal lines when the display scanning signals are outputted simultaneously. With this arrangement, display in the non-image area can be stabilized by the data signal line control means.

It is preferable that the foregoing image display device includes first deactivating means (e.g., source driver deactivating means) for deactivating the operation of the data signal line driving section, after the simultaneous output and until the next successive output with respect to a horizontal period based on the display data. Further, it is preferable that the foregoing image display device includes second deactivating means (e.g., gate driver deactivating means) for deactivating the operation of the scanning signal line driving section, after the simultaneous output and until the next successive output with respect to a horizontal period based on the display data. With this arrangement, by the provision of the first and second deactivating means, lower power consumption is further ensured.

In the image display device, the first clock signal for displaying the image display area and the second clock signal for displaying the non-image area may be different from each other. With this arrangement, the second clock signal for displaying the non-image area can be set to have a lower frequency than the first clock signal, thus further ensuring lower power consumption and stabilizing display operation by the lower frequency.

Further, the display device driving circuit in accordance with the present embodiment is a display device driving circuit which includes a scanning signal line driving section for outputting display scanning signals based on display data respectively to scanning signal lines for displaying an image according to the display data with respect to pixels which are disposed in a matrix, and the display device driving circuit comprises: input means (e.g., input section) for receiving a transition instruction signal for making a transition of output from successive output to simultaneous output with respect to the respective scanning signal lines; and control means (e.g., output control block, and more specifically, AND circuit in the output control block) for controlling the scanning signal line driving section so that the display scanning signals are outputted simultaneously with respect to the plurality of scanning signal lines based on the transition instruction signal.

Further, the scanning signal line driving section may have an arrangement including a plurality of serially connected shift register sections for outputting the display scanning signals successively to the respective scanning signal lines. Further, the control means may have an arrangement including deactivating means for deactivating the operation of the scanning signal line driving section.

Further, the driving method of the display device in accordance with the present invention may be a method for driving a display device which outputs display scanning signals respectively to scanning signal lines based on display data, and display data signals respectively to data signal lines based on the display data, and has a partial display function for a non-image area and an image display area, so as to display an image which is in accordance with the display data with respect to pixels which are disposed in a matrix, wherein the display scanning signals and the display data signals according to the non-image area are simultaneously outputted to the respective scanning signal lines and the respective data signal lines, respectively, which correspond to the non-image area.

The image display device in accordance with the present embodiment may have an arrangement including a scanning signal line driving section for outputting display scanning signals respectively to scanning signal lines based on display data, a data signal line driving section for outputting display data signals based on the display data respectively to data signal lines, and a set section for setting an image display area according to the display data and a monochromatic non-display area with respect to the pixels, so as to display an image according to the display data with respect to pixels which are disposed in a matrix, and the image display device comprises scanning signal line control means for controlling the scanning signal line driving section so that the display scanning signals are simultaneously outputted with respect to the respective scanning signal lines which correspond to the non-image area as set by the set section.

Further, the image display device in accordance with the present embodiment may have an arrangement wherein the shift register sections (e.g., bidirectional shift registers) in the display device driving circuit (e.g., gate driver) are realized by a plurality of serially connected shift registers (e.g., bidirectional shift registers), and there are provided a function of arbitrarily setting the order of serial connection of the serially connected shift registers, for example, by an external set terminal (e.g., set section), and a function of individually supplying and deactivating the shift clock to each shift register and individually resetting (deactivating) each shift register, and the display device driving circuit may be capable of a divisional start.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A display device driving circuit comprising:

a scanning signal line driving section for outputting display scanning signals respectively to scanning signal lines for displaying an image according to the display data with respect to pixels which are disposed in a matrix;

a control section including a set section in which is set each of an image display area and one or more non-image areas, each of the one or more non-image areas comprising a plurality or more of adjacent scanning signal lines, and wherein said control section is configured and arranged to determine from inputs thereto if the image data to be outputted corresponds to any of the one or more non-image areas and so as to output a transition instruction signal for each of the one or more non-image areas when it is so determined, and wherein said scanning signal line driving section includes a control means for controlling scanning line signal outputs from said scanning signal line driving section, said control means being configured and arranged to switch the output of the display scanning signals to the respective scanning signal lines from the scanning signal line driving section, based on the transition instruction signal from said control section, so as to cause a transition from successive output of display scanning signals to simultaneous output of display scanning signals, and to control the output of the display scanning signals from the scanning signal line driving section to the respective scanning signal lines based on the received transition instruction signal, so that the display scanning signals are outputted simultaneously with respect to all of the plurality or more scanning signal lines of each of the one or more non-image areas until receipt of an instructional signal of a start of a next successive output for successively outputting the display scanning signals.

2. The display device driving circuit as set forth in claim 1, wherein said scanning signal line driving section includes a plurality of serially connected shift register sections for outputting the display scanning signals with respect to the respective scanning signal lines.

3. The display device driving circuit as set forth in claim 1, comprising deactivating means for deactivating an operation of the scanning signal line driving section based on a synchronize signal and the transition instruction signal for displaying the image, where in the deactivated condition at least a portion of said scanning signal line driving section is functionally deactivated.

4. The display device driving circuit as set forth in claim 1, wherein said control means includes an unscanned area recognizing section for recognizing an unscanned area based on the transition instruction signal, and wherein said control means controls the output of the display scanning signals from the scanning signal line driving section to the respective scanning signal lines so that the display scanning signals are outputted only to the plurality or more of scanning signal lines which correspond to the unscanned area as recognized by the unscanned area recognizing section.

5. The display device driving circuit as set forth in claim 2, wherein said scanning signal line driving section has a plurality of scanning starting positions which are set in a vertical direction, and successively outputs, among the plurality of scanning starting positions, the display scanning signals to scanning signal lines which correspond to one of the one or more non-image areas, which is an area from a scanning starting position therein in the vicinity of a front portion of the image display area to the image display area, and to scanning signal lines which correspond to the image display area, and thereafter simultaneously outputs the display scanning signals to the plurality or more of scanning signal lines which correspond to an unscanned area based on the transition instruction signal.

6. The display device driving circuit as set forth in claim 5, wherein said scanning signal line driving section deactivates an operation of a display device, after simultaneously outputting the display scanning signals only to the plurality or more of scanning signal lines which correspond to the unscanned area and until next successive output is carried out, where in the deactivated condition at least a portion of said scanning signal line driving section is functionally deactivated.

7. The display device driving circuit as set forth in claim 1, wherein said control means controls the scanning signal line driving section based on the transition instruction signal so that the display scanning signals are simultaneously outputted within one horizontal period to the plurality or more of scanning signal lines of the one or more non-image areas.

8. The display device driving circuit as set forth in claim 1, wherein said control means controls the scanning signal line driving section based on the transition instruction signal so that the display scanning signals are simultaneously outputted within two horizontal periods to the plurality or more of scanning signal lines of the one or more non-image areas.

9. A display device driving circuit comprising:

a scanning signal line driving section for outputting display scanning signals respectively to scanning signal lines for displaying an image according to the display data with respect to pixels which are disposed in a matrix;

a control section including a set section in which is set each of an image display area and one or more non-image areas, each of the one or more no-image areas comprising a plurality or more of scanning lines and wherein said control section is configured and arranged to determine from inputs thereto if the image data to be outputted corresponds to any of the one or more non-image areas and so as to output a transition instruction signal for each of the one or more non-image areas when it is so determined; and wherein said scanning signal line driving section includes:

input means for receiving the transition instruction signal from said control section, the transition instruction signal for causing a transition from successive output to simultaneous output with respect to the output of the display scanning signals to the respective plurality or more of scanning signal lines of each of the one or more non-image areas; and control means for switching the output of the display scanning signals from the scanning signal line driving section to the respective scanning signal lines based on the received transition instruction signal, so as to cause a transition from successive output of display scanning signals to simultaneous output of display scanning signals, and for controlling the scanning signal line driving section based on the received transition instruction signal so that the display scanning signals are outputted simultaneously with respect to all of the plurality or more of scanning signal lines of each of the one or more non-image areas until receipt of an instructional signal of a start of a next successive output for successively outputting the display scanning signals.

10. The display device driving circuit as set forth in claim 9, wherein said scanning signal line driving section includes a plurality of serially connected shift register sections for outputting the display scanning signals with respect to the respective scanning signal lines.

11. The display device driving circuit as set forth in claim 9, wherein said control means includes deactivating means for deactivating an operation of the scanning signal line driving section based on a synchronize signal and the transition instruction signal for displaying the image, where in the deactivated condition at least a portion of said scanning signal line driving section is functionally deactivated.

12. The display device driving circuit as set forth in claim 9, wherein said control means includes an unscanned area recognizing section for recognizing an unscanned area based on the transition instruction signal, and wherein said control means controls the output of the display scanning signals from the scanning signal line driving section to the respective scanning signal lines so that the display scanning signals are outputted only to the plurality or more of scanning signal lines which correspond to the unscanned area as recognized by the unscanned area recognizing section.

13. The display device driving circuit as set forth in claim 10, wherein said scanning signal line driving section has a plurality of scanning starting positions which are set in a vertical direction, and successively outputs, among the plurality of scanning starting positions, the display scanning signals to scanning signal lines which correspond to one of the one or more non-image areas, which is an area from a scanning starting position therein in the vicinity of a front portion of the image display area to the image display area, and to scanning signal lines which correspond to the image display area, and thereafter simultaneously outputs the display scanning signals to the plurality or more of scanning signal lines which correspond to an unscanned area based on the transition instruction signal.

14. The display device driving circuit as set forth in claim 13, wherein said scanning signal line driving section deactivates an operation of a display device, after simultaneously outputting the display scanning signals only to the plurality or more of scanning signal lines which correspond to the unscanned area and until next successive output is carried out, wherein in the deactivated condition at least a portion of said scanning signal line driving section is functionally deactivated.

15. The display device driving circuit as set forth in claim 9, wherein said control means controls the scanning signal line driving section based on the transition instruction signal so that the display scanning signals are simultaneously outputted within one horizontal period to the plurality Or more of scanning signal lines of the one or more non-image areas.

16. The display device driving circuit as set forth in claim 9, wherein said control means controls the scanning signal line driving section based on the transition instruction signal so that the display scanning signals are simultaneously outputted within two horizontal periods to the plurality or more of scanning signal lines of the one or more non-image areas.

17. A driving method of a display device which outputs display scanning signals respectively to scanning signal lines, and outputs display data signals respectively to data signal lines, so as to display an image which is in accordance with the display data with respect to pixels which are disposed in a matrix, and has a partial display function for one or more non-image areas comprising a plurality or more or of scanning signal lines and an image display area, said driving method comprising the step of:

outputting a transitional instructional signal for each of the one or more non-image areas when it is determined that the image data to be outputted is that for any of the one or more non-image areas and not outputting the transitional instructional signal when it is determined that the image data to be outputted is that for the image display area; and simultaneously outputting the display scanning signals with respect to the plurality of scanning signal lines of each of the one or more non-image areas based on the outputted transition instruction signal so as to cause a transition from successive output of display scanning signals to simultaneous output of display scanning signals, so that the display scanning signals are outputted simultaneously with respect to all of the plurality or more of scanning signal lines for the one or more non-image areas until receipt of an instructional signal of a start of a next successive output for successively outputting the display scanning signals.

18. The method as set forth in claim 17, further comprising the step of deactivating the display device so that the driving device is not capable of fully performing normal operational functions, wherein said deactivating includes deactivating the display device after simultaneously outputting the display scanning signals only to the plurality or more of scanning signal lines which correspond to the unscanned area based on the transition instruction signal and until next successive output is carried out.

19. The method as set forth in claim 17, wherein, among a plurality of scanning starting positions which are set in a vertical direction, the display scanning signals are successively outputted to scanning signal lines which correspond to one of the one or more non-image areas, which is an area from a scanning starting position therein in the vicinity of a front portion of the image display area to the image display area, and to scanning signal lines which correspond to the image display area, and thereafter the display scanning signals are simultaneously outputted to a plurality or more of scanning signal lines which correspond to an unscanned area based on the transition instruction signal.

20. The method as set forth in claim 17, wherein the display scanning signals are simultaneously outputted based on the transition instruction signal to each of a first line group and a second line group of the plurality or more of scanning signal lines which correspond to an unscanned area.

21. The method as set forth in claim 17, further comprising the steps of:

outputting display scanning signals When successively outputting display scanning signals at one frequency, and outputting display scanning signals when simultaneously outputting display scanning signals at another frequency, where the another frequency is different from said one frequency.

22. The method as set forth in claim 17, wherein said simultaneously outputting includes simultaneously outputting display scanning signals according to the one or more non-image areas within one horizontal period with respect to the plurality or more of scanning signal lines which correspond to the one or more non-image areas.

23. The method as set forth in claim 17, wherein simultaneously scanning includes simultaneously scanning display scanning signals according to the one or more non-image areas within two horizontal periods with respect to the plurality or more of scanning signal lines which correspond to the one or more non-image areas.

24. A driving method of a display device which outputs display scanning signals respectively to scanning signal lines, and outputs display data signals respectively to data signal lines, so as to display an image which is in accordance with the display data with respect to pixels which are disposed in a matrix, and has a partial display function for a non-image area comprising a plurality or more of scanning lines and an image display area, said method comprising the steps of:

distinguishing a predetermined image display area and a predetermined non-image area from each other;

simultaneously outputting the display scanning signals and the display data signals respectively to the respective plurality or more of scanning signal lines of the non-image area and the respective data signal lines which correspond to the non-image area responsive to said distinguishing; and following said simultaneously outputting, deactivating operation of a scanning signal line driving section until next display is carried out, where in the deactivated condition at least a portion of the scanning signal line driving section is shutdown/turned off such that the portion is not consuming power and so the scanning signal line driving section is thereby incapable of providing output signals until the driving section is turned on when the next display is carried out.

25. The method as set forth in claim 24, wherein said simultaneously outputting includes simultaneously outputting display scanning signals according to the non-image area within one horizontal period with respect to the plurality or more of scanning signal lines which correspond to the non-image area.

26. The method as set forth in claim 24, wherein said simultaneously outputting includes simultaneously outputting display scanning signals according to the non-image area within two horizontal periods with respect to the plurality or more scanning signal lines which correspond to the non-image area.

27. An image display device comprising:

a scanning signal line driving section for outputting display scanning signals respectively to scanning signal lines, a data signal line driving section for outputting display data signals respectively to data signal lines, so as to display an image according to the display data with respect to pixels which are disposed in a matrix, said pixels having a partial display function for an image display area including a plurality or more of scanning signal lines and a non-image area, means for distinguishing the image display area and the non-image area from each other and for outputting a transition instructional signal for the non-image area responsive to said distinguishing; and scanning signal line control means for switching the output of the display scanning signals to the respective scanning signal lines from the scanning signal driving section, based on the outputted transition instruction signal so as to cause a transition from successive output of display scanning signals to simultaneous output of display scanning signals, and for controlling the output of the display scanning signals from the scanning signal line driving section to the respective scanning signal lines based on the outputted transition instruction signal, so that the display scanning signals are outputted simultaneously with respect to all of the plurality or more scanning signal lines for the non-image area until receipt of an instructional signal of a start of a next successive output for successively outputting the display scanning signals.

28. The image display device as set forth in claim 27, wherein said scanning signal line driving section includes a plurality of serially connected shift register sections for outputting the display scanning signals to the respective scanning signal lines and includes a plurality of scanning starting positions which are set in a vertical direction, said scanning signal line driving section successively outputting, among the plurality of scanning starting positions, the display scanning signals to scanning signal lines which correspond to the non-image area, which is an area from a scanning starting position therein in the vicinity of a front portion of the image display area to the image display area, and to scanning signal lines which correspond to the image display area, and thereafter simultaneously outputting, based on the outputted transition instruction signal, the display scanning signals to the plurality or more of scanning signal lines which correspond to an unscanned area.

29. The image display device as set forth in claim 27, wherein said scanning signal line control means controls the output of the display scanning signals from the scanning signal line driving section to the respective scanning signal lines so that an operation of the image display device is deactivated after simultaneously outputting the display scanning signals only to the plurality or more scanning signal lines which correspond to the unscanned area based on the outputted transition instruction signal and until next successive output is carried out, where in the deactivated condition at least a portion of said scanning signal line driving section is functionally deactivated.

30. The image display device as set forth in claim 27, wherein said scanning signal line control means controls the output of the display scanning signals from the scanning signal line driving section to the respective scanning signal lines based on the outputted transition instruction signal so that the display scanning signals are simultaneously outputted to each of a first line group and a second line group of the plurality or more of scanning signal lines which correspond to an unscanned area.

31. The image display device as set forth in claim 27, wherein said scanning signal line control means controls the scanning signal line driving section based on the outputted transition instruction signal so that the display scanning signals are outputted simultaneously within one horizontal period with respect to the plurality or more of scanning signal lines of the non-image area.

32. The image display device as set forth in claim 27, wherein said scanning signal line control means controls the scanning signal line driving section based on the outputted transition instruction signal so that the display scanning signals are outputted simultaneously within two horizontal periods with respect to the plurality or more of scanning signal lines of the non-image area.

33. An image display device comprising:

a scanning signal line driving section for outputting display scanning signals respectively to scanning signal lines, a data signal line driving section for outputting display data signals respectively to data signal lines, a set section for setting an image display area according to the display data and a non-image area with respect to pixels, so as to display an image according to the display data with respect to the pixels which are disposed in a matrix and for outputting a transition instruction signal when the display scanning signals to be outputted are for the non-image area, scanning signal line control means for controlling the scanning signal line driving section, the scanning signal line control means being configured and arranged so that the display scanning signals are simultaneously outputted with respect to the plurality or more of scanning signal lines which correspond to the non-image area as set by the set section responsive to the outputted transition instruction signal, the scanning signal line driving section including a plurality of serially connected shift register sections for outputting the display scanning signals respectively to the scanning signal lines, the scanning signal line control means individually and simultaneously scanning the shift register sections in the non-image area, and wherein to the serially connected shift registers, respective start pulse signals are supplied and being signaled by the start pulse signals, scanning of the scanning signal lines is started.

34. The image display device as set forth in claim 33, comprising data signal line control means for controlling the data signal line driving section so as to output the display data signals for the non-image area to the respective data signal lines when the display scanning signals are simultaneously outputted.

35. The image display device as set forth in claim 33, comprising first deactivating means for deactivating an operation of the data signal line driving section after the simultaneous output and until next successive output with respect to a horizontal period based on the display data, where in the deactivated condition at least a portion of the data signal line driving section is functionally deactivated.

36. The image display device as set forth in claim 33, comprising second deactivating means for deactivating an operation of the scanning signal line driving section after the simultaneous output and until next successive output with respect to a horizontal period based on the display data, where in the deactivated condition at least a portion of the scanning signal line driving section is functionally deactivated.

37. The image display device as set forth in claim 33, further comprising a first clock generating means for generating a first clock signal for displaying the image display area and a second clock generating means for generating a second clock signal for displaying the non-image area, wherein the first and second clock signals being generated are different from each other.

38. The image display device as set forth in claim 33, wherein said scanning signal line control means controls the scanning signal line driving section based on the outputted transition instruction signal so that the display scanning signals are outputted simultaneously within one horizontal period with respect to the plurality or more scanning signal lines of the non-image area.

39. The image display device as set forth in claim 33, wherein said scanning signal line control means controls the scanning signal line driving section based on the outputted transition instruction signal so that the display scanning signals are outputted simultaneously within two horizontal periods with respect to the plurality or more of scanning signal lines of the non-image area.

40. The method as set forth in claim 17, wherein the display scanning signals are outputted based on the outputted transition instruction signal simultaneously to an odd-numbered line group of the plurality or more of scanning signal lines that correspond to an unscanned area and simultaneously to an even-numbered line group of the plurality or more of scanning signal lines that correspond to the unscanned area.

41. The method as set forth in claim 17, wherein the display scanning signals are outputted based on the outputted transition instruction signal simultaneously to odd-numbered pairs of adjacent ones of the plurality or more of scanning signal lines that correspond to an unscanned area and simultaneously to even-numbered pairs of adjacent ones of the plurality or more of scanning signal lines that correspond to the unscanned area.

42. A display device driving circuit which includes a scanning signal line driving section for outputting display scanning signals respectively to scanning signal lines for displaying an image according to the display data with respect to pixels which are disposed in a matrix; said display device driving circuit comprising:

means for distinguishing an image display area and a non-image area from each other and for outputting a transition instructional signal for the non-image area;

deactivating means for deactivating operation of the scanning signal line driving section based on a synchronize signal for image display and based on the transition instruction signal, where in the deactivated condition at least a portion of said scanning signal line driving section is functionally deactivated; and control means for switching the output of the display scanning signals to the respective scanning signal lines based on the transition instruction signal so as to cause a transition from successive output of display scanning signals to simultaneous output of display scanning signals, and for controlling the output of the display scanning signals from the scanning signal line driving section to the respective scanning signal lines based on the received transition instruction signal, so that the display scanning signals are outputted simultaneously within one horizontal period or two horizontal periods with respect to all of a plurality or more of scanning signal lines of the non-image area until next scanning is started.

43. A driving method of a display device which outputs display scanning signals respectively to scanning signal lines, and outputs display data signals respectively to data signal lines, so as to display an image which is in accordance with the display data with respect to pixels which are disposed in a matrix, the display device having a partial display function for a non-image area comprising a plurality or more of scanning signal lines and an image display area, horizontal signal lines in a vertical period of the display device being greater in number than the scanning signal lines, said method comprising the step of:

simultaneously outputting the display scanning signals and the display data signals according to the non-image area with respect to the respective plurality or more of scanning signal lines and the respective data signal lines that correspond to the non-image area;

wherein following said simultaneously outputting, suspending operation of at least a portion of the scanning signal line driving section to decrease power consumption; and wherein the number of horizontal signal lines in a vertical period shall be understood to correspond to the number of scanning signal lines of input video signals.

44. A display device driving circuit for a display that is divided into an image display area in which full image display function is allowed and one or more non-image areas at least one of comprising a plurality or more of scanning signal lines having a partial image display function; said display device driving circuit comprising:

a scanning signal line driving section for outputting display scanning signals respectively to scanning signal lines for displaying an image according to the display data with respect to pixels which are disposed in a matrix;

output control circuitry that is configured and arranged so as to distinguish between the image display area and the one or more non-image areas, where an external transition instruction signal is inputted to the control circuitry so as to identify each of the one or more non-display areas and so as to switch the output of the display scanning signals from the scanning line driving section to the respective plurality or more of scanning signal lines of the one or more non-image areas between one of a successive display scanning signal output mode and a simultaneous display scanning signal output mode responsive to such distinguishing;

wherein the output control circuitry is configured and arranged so the output of the display scanning signals from the scanning line driving section to the respective scanning signal lines is in the simultaneous output mode, responsive to the receipt of the transition instruction signal, and so as to control the output of the display scanning signals from the scanning signal line driving section to the respective scanning signal lines so that the display scanning signals are outputted simultaneously with respect to all of the plurality or more of scanning signal lines; and wherein the output control circuitry is configured and arranged so the output of the display scanning signals from the scanning line driving section to the respective scanning signal lines is in the successive output mode when the output control circuitry distinguishes the display area and so as to control the output of the display scanning signals from the scanning signal line driving section to the respective scanning signal lines so that the display scanning signals are successively outputted to the respective scanning signal lines for the display area.

45. The display device driving circuit of claim 44, wherein the output control circuitry includes an un-scanned area recognizing section that is configured and arranged so as to recognizing that an area that has not been scanned responsive to the external transitional instruction signal, and wherein the output control circuitry is configured and arranged so the output of the display scanning signals from the scanning line driving section to the respective scanning signal lines is in the simultaneous output mode, responsive to the receipt of the transition instruction signal, and so as to control the output of the display scanning signals from the scanning signal line driving section to the respective scanning signal lines so that the display scanning signals are outputted simultaneously only to the plurality or more of those scanning signal lines which correspond to the unscanned area as recognized by the unscanned area recognizing section.

46. The display device driving circuit of claim 44, wherein the output control circuitry includes an input section and a scanning area judging section;

wherein the input section is configured and arranged so as to generate a first pulse signal responsive to the received transitional instruction signal;

wherein the judging section is configured and arranged so as to judge an area to be one of the one or more non-image areas when a first pulse signal is received from the input section and to judge the area to be the image display area when there is no first pulse signal.

47. The display device driving circuit as set forth in claim 46, wherein said scanning signal line driving section includes a plurality of serially connected shift register sections for outputting second pulse signals therefrom to the judging section; and wherein the judging section is configured and arranged so as to judge the area to be the image display area when second pulse signals are received and there is no first pulse signal.

48. The display device driving circuit as set forth in claim 47, wherein the judging section includes a plurality of logic elements one for each of the plurality of shift register sections and each of the plurality of logic elements are arranged so as to be operably coupled to a respective one of the plurality of shift register sections and to the input section.

49. The display device driving circuit as set forth in claim 47, wherein said scanning signal line driving section further includes a level shifter and wherein said judging section is operably coupled between the level shifter and each of the shift register sections and the input section.

50. The display device driving circuit as set forth in claim 49, wherein the judging section includes a plurality of logic elements one for each of the plurality of shift register sections and each of the plurality of logic elements are arranged so as to be operably coupled to a respective one of the plurality of shift register sections, to the input section and to the level shifter.

51. The display device driving circuit as set forth in claim 47, wherein said scanning signal line driving section has a plurality of scanning starting positions which are set in a vertical direction, and successively outputs, among the plurality of scanning starting positions, the display scanning signals to scanning signal lines which correspond to one of the one or more non-image areas, which is an area from a scanning starting position therein in the vicinity of a front portion of the image display area to the image display area, and to scanning signal lines which correspond to the image display area, and thereafter simultaneously outputs the display scanning signals to the plurality or more of scanning signal lines which correspond to an unscanned area based on the transition instruction signal.

52. The display device driving circuit as set forth in claim 44, wherein said output control circuitry is configured and arranged so as to control the scanning signal line driving section based on the transition instruction signal so that the display scanning signals are simultaneously outputted within one horizontal period to the plurality or more of scanning signal lines of the one or more non-image areas.

53. The display device driving circuit as set forth in claim 44, wherein said output control circuitry is configured and arranged so as to control the scanning signal line driving section based on the transition instruction signal so that the display scanning signals are simultaneously outputted within two horizontal periods to the plurality or more of scanning signal lines of the one or more non-image areas.

54. An image display device comprising:

a scanning signal line driving section for outputting display scanning signals respectively to scanning signal lines, a data signal line driving section for outputting display data signals respectively to data signal lines, a set section for setting an image display area according to the display data and one or more non-image areas with respect to pixels, so as to display an image according to the display data with respect to the pixels which are disposed in a matrix, where at least one of the one or more non-image areas comprises a plurality or more of scanning signal lines, output control circuitry that is configured and arranged so as to distinguish between the image display area and the one or more non-image areas, where an external transition instruction signal is inputted to the control circuitry so as to identify each of the one or more non-display areas as set in the setting section and so as to switch the output of the display scanning signals from the scanning line driving section to the respective plurality or more of scanning signal lines for any of the one or more non-image areas between one of a successive display scanning signal output mode and a simultaneous display scanning signal output mode responsive to such distinguishing;

wherein the output control circuitry is configured and arranged so the output of the display scanning signals from the scanning line driving section to the respective scanning signal lines is in the simultaneous output mode, responsive to the receipt of the transition instruction signal, and so as to control the output of the display scanning signals from the scanning signal line driving section to the respective scanning signal lines so that the display scanning signals are outputted simultaneously with respect to all of the plurality or more of scanning signal lines; and wherein the output control circuitry is configured and arranged so the output of the display scanning signals from the scanning line driving section to the respective scanning signal lines is in the successive output mode when the output control circuitry distinguishes the display area and so as to control the output of the display scanning signals from the scanning signal line driving section to the respective scanning signal lines so that the display scanning signals are successively outputted to the respective scanning signal lines for the display area.

55. The display device of claim 54, wherein:

the output control circuitry includes an input section and a scanning area judging section, where the input section is configured and arranged so as to generate a first pulse signal responsive to the received transitional instruction signal;

said scanning signal line driving section includes a plurality of serially connected shift register sections for outputting second pulse signals therefrom to the judging section; and the judging section is configured and arranged so as to judge an area to be one of the one or more non-image areas when a first pulse signal is received from the input section and to judge the area to be the image display area when there is no first pulse signal and second pulse signals are being received.

56. The display device as set forth in claim 55, wherein the judging section includes a plurality of logic elements one for each of the plurality of shift register sections and each of the plurality of logic elements are arranged so as to be operably coupled to a respective one of the plurality of shift register sections and to the input section.

57. The display device as set forth in claim 55, wherein said scanning signal line driving section further includes a level shifter and wherein said judging section is operably coupled between the level shifter and each of the shift register sections and the input section.

58. The display device driving circuit as set forth in claim 57, wherein the judging section includes a plurality of logic elements one for each of the plurality of shift register sections and each of the plurality of logic elements are arranged so as to be operably coupled to a respective one of the plurality of shift register sections, to the input section and to the level shifter.

* * * * *